US009818593B2

(12) United States Patent
Solouki et al.

(10) Patent No.: US 9,818,593 B2
(45) Date of Patent: Nov. 14, 2017

(54) RADIO-FREQUENCY IONIZATION OF CHEMICALS

(71) Applicant: UNIVERSITY OF MAINE SYSTEM BOARD OF TRUSTEES, Bangor, ME (US)

(72) Inventors: Touradj Solouki, Hewitt, TX (US); Behrooz Zekavat, Waco, TX (US)

(73) Assignee: University of Maine System Board of Trustees, Bangor, MA (US)

( * ) Notice: Subject to any disclaimer, the term of this patent is extended or adjusted under 35 U.S.C. 154(b) by 0 days.

(21) Appl. No.: 14/426,475

(22) PCT Filed: Sep. 13, 2013

(86) PCT No.: PCT/US2013/059818

§ 371 (c)(1),
(2) Date: Mar. 6, 2015

(87) PCT Pub. No.: WO2014/043583

PCT Pub. Date: Mar. 20, 2014

(65) Prior Publication Data

US 2015/0221492 A1 Aug. 6, 2015

Related U.S. Application Data

(60) Provisional application No. 61/700,532, filed on Sep. 13, 2012.

(51) Int. Cl.

| | |
|---|---|
| ***H01J 49/00*** | (2006.01) |
| ***H01J 49/10*** | (2006.01) |
| ***H01J 27/16*** | (2006.01) |
| ***H01J 49/36*** | (2006.01) |

(52) U.S. Cl.
CPC ..... *H01J 49/105* (2013.01); *H01J 27/16* (2013.01); *H01J 49/36* (2013.01)

(58) Field of Classification Search
CPC ..... H01J 27/16; H01J 49/105; H01J 49/36; H01J 49/145
See application file for complete search history.

(56) References Cited

U.S. PATENT DOCUMENTS

| | | | | |
|---|---|---|---|---|
| 3,937,955 | A | 2/1976 | Comisarow et al. | |
| 4,771,172 | A | 9/1988 | Weber-Grabau et al. | |
| 5,389,784 | A | 2/1995 | Weller | |
| 2001/0038077 | A1 | 11/2001 | Chutjian et al. | |
| 2003/0070913 | A1* | 4/2003 | Miller | G01N 21/68 204/192.1 |
| 2003/0178563 | A1 | 9/2003 | Makarov et al. | |

(Continued)

OTHER PUBLICATIONS

Canakci, M., et al., Impact of alcohol—gasoline fuel blends on the exhaust emission of an SI engine, Renewable Energy, 52:111-117 (2013).

(Continued)

*Primary Examiner* — Wyatt Stoffa
(74) *Attorney, Agent, or Firm* — Choate, Hall & Stewart, LLP

(57) ABSTRACT

Methods and systems for performing ionization, including applying radio frequency energy to a chemical compound so that at least one ion of the compound or of a compound fragment is generated, and detecting at least one such ion.

23 Claims, 18 Drawing Sheets

(56) References Cited

U.S. PATENT DOCUMENTS

| | | | | |
|---|---|---|---|---|
| 2004/0032211 | A1* | 2/2004 | Langford | H01J 27/16 315/111.31 |
| 2007/0138406 | A1 | 6/2007 | Mordehai | |
| 2010/0320379 | A1* | 12/2010 | Morrisroe | F23C 99/003 250/288 |
| 2011/0095180 | A1 | 4/2011 | Taniguchi | |
| 2011/0240848 | A1 | 10/2011 | Wells | |
| 2011/0253889 | A1 | 10/2011 | Ishimaru et al. | |
| 2013/0299691 | A1* | 11/2013 | Jones | H01J 49/145 250/282 |
| 2015/0170895 | A1* | 6/2015 | Morrisroe | F23C 99/003 250/282 |
| 2015/0228466 | A1* | 8/2015 | Makarov | H01J 49/067 250/282 |

OTHER PUBLICATIONS

International Search Report for PCT/US2013/059818, 5 pages (dated Apr. 21, 2014).

Lecroy, C. et al., Nitrogen, biochar, and mycorrhizae: Alteration of the symbiosis and oxidation of the char surface, Soil Biology & Biochemistry, 58:248-254 (2013).

Liang, F. et al., Fingerprint identification of volatile organic compounds in gasoline contaminated groundwater using gas chromatography differential ion mobility spectrometry, International Journal for Ion Mobility Spectrometry, 15:169-177 (2012).

Misron, N. et al., Performance Improvement of a Portable Electric Generator Using an Optimized Bio-Fuel Ratio in a Single Cylinder Two-Stroke Engine, Energies, 4:1937-1949 (2011).

Szulejko, J. and Solouki, T. Potential analytical applications of interfacing a GC to an FT-ICR MS: fingerprinting complex sample matrixes, Analytical Chemistry, 74(14):3434-3442 (2002).

Szulejko, J. et al., Simultaneous determination of analyte concentrations, gas-phase basicities, and proton transfer kinetics using gas chromatography/Fourier transform ion cyclotron resonance mass spectrometry, International Journal of Mass Spectrum, 257(1-3):16-26 (2006).

Written Opinion for PCT/US2013/059818, 7 pages (dated Apr. 21, 2014).

Zekavat, B. and Solouki, T., Radio-frequency ionization of organic compounds for mass spectrometry analysis, Angewandte Chemie International Edition England, 52(9):2426-2429 (2013).

* cited by examiner

Without Wire Ion Guide

With Wire Ion Guide

RFI [Acetone]

EI [Acetone]

RADIO-FREQUENCY IONIZATION OF CHEMICALS

CROSS-REFERENCE TO RELATED APPLICATION

This Patent Application is a National Stage Entry of International Patent Application No. PCT/US2013/059818, filed Sep. 13, 2013, which designates the U.S., and which claims the benefit of U.S. Provisional Application Ser. No. 61/700,532, filed Sep. 13, 2012, the entire content of both of which are incorporated herein by reference herein.

GOVERNMENT LICENSE RIGHTS

This invention was made with support from the Institute for Therapeutic Discovery and government support under Grant No. CDMRP-OC060322, awarded by the Department of Defense. The government has certain rights in the invention.

BACKGROUND

A variety of technologies for the detection and/or analysis of chemical compounds or entities rely on or require detection of ions (e.g., ionic forms of the detected compounds or entities). The present disclosure provides new methods and systems for achieving ionization of organic compounds. In particular, the present disclosure describes radio-frequency ionization (RFI) of organic materials.

SUMMARY

Among other things, the present disclosure encompasses the surprising insight that ions of chemical compounds (e.g., organic compounds), or fragments thereof, can be generated with high efficiency through application of radio frequency energy to the compounds. For example, in some embodiments, a radio frequency signal is applied to one or more ion guide rods to which a sample comprising the compound of interest is exposed. In some embodiments, provided ionization systems and techniques are particularly useful in methodologies and/or systems involving the detection of entities with mass spectrometry.

Among other things, the present invention encompasses the recognition that many common ionization sources typically utilized in association with mass spectrometry technologies can result in undesirable background noise and/or pressure, for example as can be caused by outgassing of heated or energized electrical components. In some embodiments, use of RFI technologies as provided by the present disclosure reduces, avoids, or eliminates such undesirable background noise and/or pressure. One advantage provided by certain embodiments of the present invention is that use of RFI with mass spectroscopy achieves dramatically improved signal-to-noise, on the order of at least a six-fold improvement, when compared with certain common ionization techniques. Additionally, by altering the duration of emission at the source, RFI permits control of the degree and extent of parent ion fragmentation, allowing use of RFI to cause both "soft" and "hard" ionization.

In some embodiments, the present invention provides methods including steps of applying radio frequency (RF) energy to a chemical compound so that at least one ion of the compound or of a compound fragment is generated, and detecting at least one such ion. In some embodiments, such application of RF energy is performed in a chamber. In some embodiments, such application of RF energy involves applying a RF signal to at least one ion guide rod that is part of an ion guide assemble positioned relative to a pair of trapping plates that define first and second ends of a cell, the first of which such trapping plates has an opening allowing passage of ions therethrough, so that a gap is defined between an exposed face of the at least one guide rod and the first trapping plate so that, when a sample comprising the chemical compound passes through the opening, ionization of the compound occurs. In some embodiments, fragmentation of the compound also occurs, such that ionized fragments are generated.

Thus, in some embodiments, the present invention provides methods for performing ionization including steps of providing a chamber, introducing one or more chemical compounds to the chamber, applying radiofrequency energy to the one or more chemical compounds so that at least one ion of the compound or of a compound fragment is generated, and detecting at least one such ion.

Alternatively or additionally, in some embodiments, the present invention provides methods for performing ionization, including providing a pair of trapping plates located within a chamber, wherein the pair of trapping plates define a first end and a second end of a cell, the first end trapping plate comprising at least one opening allowing passage of ions therethrough; and applying a radio frequency (RF) signal to an ion guide assembly comprising at least one ion guide rod, wherein the ions are formed in a gap between an exposed end of the at least one ion guide rod and the first end trapping plate.

According to various embodiments, the present invention provides for ionization systems including a source of radio frequency (RF) energy for providing power for production of ions, a chamber, a pair of trapping plates located within the chamber, wherein the pair of trapping plates defines a first end and a second end of a cell, the first end trapping plate comprising at least one opening allowing passage of ions therethrough; and an ion guide assembly comprising at least one ion guide rod, wherein the ions are formed in a gap between an exposed end of the at least one ion guide rod and the first end trapping plate. In some such embodiments, when a chemical compound is ionized (and optionally fragmented) in a gap and passes through the opening for detection.

In some embodiments, the frequency of the RF signal applied to the at least one ion guide rod may be within a range between about 1.0 MHz and about 100 MHz, inclusive. For example, in some embodiments, such range has a lower bound of about 2.0 MHz, about 3.0 MHz, about 4.0 MHz, about 4.5 MHz, about 5.0 MHz, about 5.5 MHz, about 6.0 MHz, about 10. MHz, about 12 MHz, about 12.5 MHz, about 13 MHz, or about 20 MHz and an upper bound of about 95 MHz, about 90 MHz, about 80 MHz, about 70 MHz, about 60 MHz, about 50 MHz, about 40 MHz, about 30 MHz, about 20 MHz, about 10 MHz, about 8 MHz, about 6.5 MHZ, or about 6 MHz, the upper bound being larger than the lower bound. In some embodiments, the upper bound is greater than 7.0 MHz. In some embodiments, the lower bound is below 4 MHz.

In various embodiments, the gap between the exposed end of the at least one ion guide rod and the first end trapping plate is between about 0.01 μm and about 4 mm. For example, in some embodiments, such range has a lower bound of about 0.1 μm, about 1.0 μm, about 0.01 mm, about 0.05 mm, about 1.0 mm, about 1.5 mm, about 2.0 mm, or about 2.5 mm and an upper bound of about 4 mm, about 3.5 mm, about 3.0 mm, about 2.5 mm, or about 2.0 mm, the upper bound being larger than the lower bound. In some embodiments, the size of the gap is selected in accordance with the frequency of the RF signal to be applied to the at least one rod. In some embodiments, use of a longer wavelength (i.e. lower frequency) and lower voltage RF signal is associated with a smaller gap than use of a shorter wavelength (i.e. higher frequency) and higher voltage RF signal.

In some embodiments, the ion guide assembly comprises at least one ion guide rod. In some embodiments, the ion guide assembly comprises a plurality of ion guide rods for example, two, three, four, five, six, seven, eight, or more ion guide rods. In some embodiments, the plurality of ion guide rods are arranged symmetrically around a central axis, which runs longitudinally parallel to the plurality of ion guide rods. In some embodiments, the at least one opening in the first trapping plate is located out of alignment with the central axis of the ion guide assembly.

In some embodiments, the at least one opening in the first trapping plate has a diameter between about 1 nm and about 1.0 cm. For example, in some embodiments, such range has a lower bound of about 1 nm, about 1 μm, about 0.1 cm, about 0.2 cm, about 0.3 cm, about 0.4 cm, about 0.5 cm, or about 0.6 cm and an upper bound of about 1 cm, about 0.9 cm, about 0.8 cm, about 0.7 cm, about 0.6 cm, about 0.5 cm, about 0.1 cm, or about 10 μm, the upper bound being larger than the lower bound. In some embodiments, the at least one opening is larger than 1.0 cm.

In some embodiments, methods provided by the present invention comprise introducing an analyte (i.e., comprising one or more chemical compounds) into a chamber. In some embodiments, the chamber is arranged and constructed to support application of a vacuum. In some embodiments, the analyte may be introduced through an aperture in a wall defining a boundary of the chamber. In some embodiments, the aperture may be or comprise a port, valve, or other structure allowing for controlled introduction of an analyte into the vacuum chamber. In some embodiments, the analyte is in the form of a gas when introduced into the chamber. In some embodiments, the analyte is in the form of a liquid when introduced into the chamber. In some embodiments, the analyte is in the form of a solid when introduced into the chamber.

It is contemplated an analyte, after introduction into the chamber, may have any pressure that would provide one or more analyte molecules, according to various embodiments. In some embodiments, the analyte, after introduction into the chamber, has a partial pressure between about $1\times10^{-12}$ torr and about $1\times10^{-3}$ torr. For example, in some embodiments, such range has a lower bound of about $1\times10^{-11}$, about $1\times10^{-10}$, about $1\times10^{-8}$, about $1\times10^{-6}$, or about $1\times10^{-4}$, and an upper bound of about $1\times10^{-4}$, about $1\times10^{-5}$, about $1\times10^{-6}$, about $1\times10^{-8}$, about $1\times10^{-10}$, or about $1\times10^{-11}$, the upper bound being larger than the lower bound.

In some embodiments, systems and methods provided by the present invention include detecting one or more ions (e.g., of the chemical compound and/or of one or more fragments thereof). In some embodiments, such detection comprises mass spectrometry (MS)(e.g., comprises collecting at least one mass spectrum). In some embodiments, the MS is or comprises quadrupole MS, Fourier Transform Ion Cyclotron Resonance (FT-ICR) MS, and/or Time-Of-Flight (TOF) MS. Also, all other types of mass spectrometers, ion mobility devices, and ion detectors are contemplated as within the scope of the present invention and may be used for ion detection.

According to some embodiments, RF signal is applied to the at least one ion guide rod for a period of time that lasts for between about 0.01 ms and about 5.0 s. For example, in some embodiments, such range has a lower bound of about 0.01 ms, about 0.1 ms, about 1.0 ms, about 10 ms, 0.05 s, about 0.1 s, about 0.5 s, about 1.0 s, or about 1.5 s and an upper bound of about 4.5 s, about 4 s, about 3.5 s, about 3 s, about 2.5 s, about 2.0 s, about 1.5 s, about 1.0 s, or about 0.5 s, the upper end being larger than the lower bound. In some embodiments, the period of time is sufficient to yield mass spectra resembling hard ionization of the analyte. In some embodiments, the period of time is sufficient to yield mass spectra resembling soft ionization of the analyte. In some embodiments, the RF signal is applied to the at least one ion guide for more than 5.0 seconds.

In some embodiments, a wire ion guide is positioned between the first and second end trapping plates, wherein the wire ion guide is electrically isolated from the cell, and a voltage is applied during ion excitation and/or detection. It is contemplated the wire may be comprised of any conducting material. In some embodiments, the wire may be comprised of a metal material such as for example, copper, silver, gold, or another appropriate metal. In some embodiments, the voltage is pulsed.

In some embodiments, the RF signal is applied by an RF source in operational association with the at least one ion guide rod to which it is applied. According to various embodiments, the RF source is located in the chamber.

As used in this application, the terms "about" and "approximately" are used as equivalents. Any numerals used in this application with or without about/approximately are meant to cover any normal fluctuations appreciated by one of ordinary skill in the relevant art.

Other features, objects, and advantages of the present invention are apparent in the detailed description that follows. It should be understood, however, that the detailed description, while indicating embodiments of the present invention, is given by way of illustration only, not limitation. Various changes and modifications within the scope of the invention will become apparent to those skilled in the art from the detailed description.

BRIEF DESCRIPTION OF THE FIGURES

The foregoing and other objects, aspects, features, and advantages of the present disclosure will become more apparent and better understood by referring to the following description taken in conjunction with the accompanying figures in which.

DETAILED DESCRIPTION OF CERTAIN EMBODIMENTS

Figure 1:
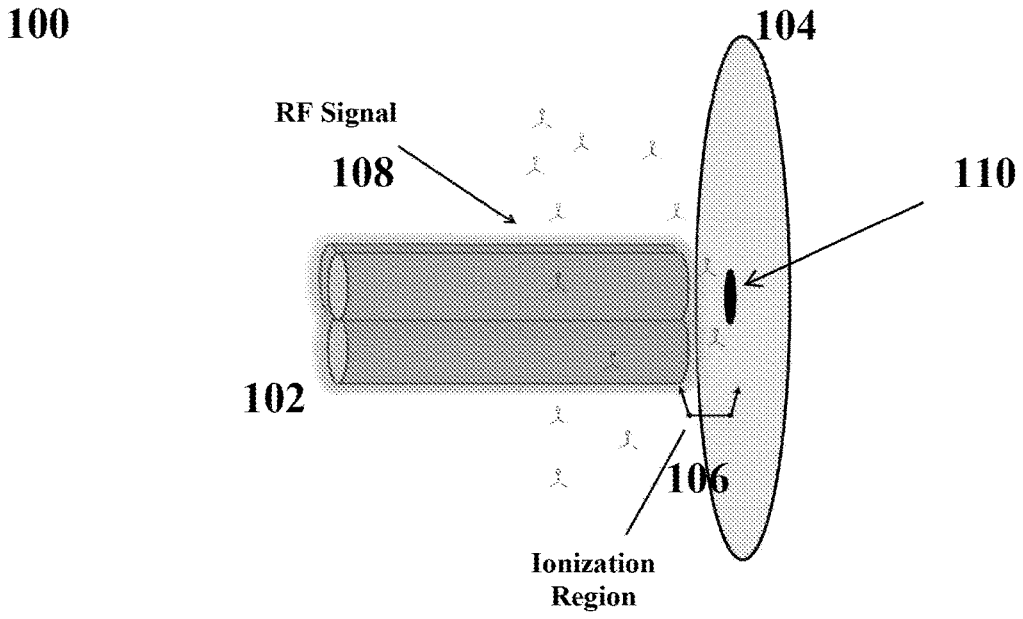
FIG. 1 shows an exemplary schematic of an ionization quadrupole ion guide rod assembly adjacent to a quadrupole trapping plate, together defining an ionization region wherein RF energy flows.

The present invention provides, among other things, systems and methods for using radio frequency energy to ionize an analyte (e.g., a compound within a chemical mixture/sample). The present invention is based, in part, on the surprising discovery that radio frequency energy can be used as an energy source for ionization of analytes, including both "soft" ionization as well as "hard" ionization. In some embodiments, radio frequency ionization (RFI) in mass spectrometry has surprisingly demonstrated at least a six-fold improvement in signal-to-noise ratio when compared with other ionization techniques such as electron impact ionization. In some embodiments, RFI of a target analyte occurs in an ionization region outside, but adjacent to, a portion of the mass spectrometer dedicated to separation and detection of analyte ions. In some embodiments, using RFI is advantageous as compared to traditional ionization energy sources, such as electron impact ionization (EI), because such use allows for a reduction or even elimination of the pressure and background noise caused by outgassing of heated or energized electrical components of common ionization sources and techniques. Additionally, by adjusting the emission duration at the RF source, it is possible to control the degree and extent of parent ion fragmentation.

Ionization Sources and Methods in General

Ionization is a process by which an atom or molecule obtains either a negative charge by acquiring an electron or a positive charge by losing an electron. Ionization may also occur when an atom or molecule combines with another atom or molecule that already has a charge. Negatively charged ions may be generated by a process known as electron capture ionization. Typically, a negative ionization occurs through a collision between an electron and an atom of a molecule, resulting in the electron being trapped by the molecule. Typically, a positively charged ion is formed when sufficient energy is transferred to a bound electron of an atom of a molecule such that the electron is freed from the molecule. The threshold energy required to remove an electron on a particular atom of a particular molecule is referred to as its ionization potential. See "MASS SPECTROMETRY: Principles and Applications" (1996, John Wiley & Sons) co-authored by E. D. Hoffmann, J. Charette, V. Stroobant, Page 288, which is hereby incorporated by reference in its entirety.

While ions form naturally, under certain circumstances it is desirable to facilitate ionization using a form of directed energy. Various methods and sources for ionization exist, including: corona discharge, electron impact ionization, chemical ionization, glow discharge ionization, atmospheric pressure chemical ionization, atmospheric pressure photoionization, electrospray ionization, matrix-assisted laser desorption ionization, and vacuum laser ionization. Applications for ionization include mass spectrometry, ion mobility spectrometry, and determination of molecular weight and/or bond energy of a target substance. Mass spectrometry in particular is a powerful analytical technique for performing chemical and molecular analysis.

The following equation provides a generic representation of positive photoionization of a molecule, M:

$$M+h\nu \rightarrow M^{+\bullet}+e^{-} \quad \text{Equation 1}$$

While depicted in Equation 1 as light, the energy source may be an ion, a radioactive element or another electron. A wide variety of ionization techniques are known, including: corona discharge, atmospheric pressure photoionization, dopant-assisted atmospheric pressure photoionization, atmospheric pressure chemical ionization, radioactive source ionization, laser desorption ionization, electron impact ionization, chemical ionization, glow discharge, inductively coupled plasma, electrospray ionization, spark ionization, and matrix-assisted laser desorption electrospray ionization, among others.

The present invention is based, at least in part, on the use of radio frequency energy to cause ionization of one or more analytes, for example, one or more chemical compounds. While the present disclosure focuses primarily on ionization as used with mass spectrometry, ionization is applicable in other techniques and analytical methods, for example, bond energy determination, in which the bond strength of a chemical bond is calculated as the heat required to break one mole of molecules into their individual atoms, or the treatment of certain diseases, such as cancer. It is contemplated that provided radiofrequency ionization (RFI) methods and systems may be used in any known process or system in which ionization provides a benefit or advantage.

Mass Spectrometry

According to various embodiments, provided methods and systems may be used in conjunction with one or more mass spectrometry techniques. Mass spectrometry is an analytical technique used to determine the chemical composition of a substance by analyzing and quantifying its component atoms and molecules. In mass spectrometry, the chemical composition of a target analyte is determined by assessing the mass and concentration of the components of the analyte. Mass spectrometry is broadly applicable across industry and for research applications, including, but not limited to: 1) biotechnology, where it may be used to analyze proteins and peptides, 2) in the pharmaceutical industry, where it may be used to develop new drugs, 3) in medicine, where it is used for testing and screening (e.g. disease biomarker detection), 4) in geology, where it is used in the study oil composition, 5) environmental engineering, where it is used to analyze water and food samples for contamination, and 6) forensics, where it is used to detect the presence of certain materials such as residue from explosives. Mass spectrometry, as a technique, encompasses three major components: ionization of a vaporized analyte, separation of the components by mass to charge ratio, and detection and plotting of the result for analysis.

In mass spectrometry, a target analyte is vaporized and bombarded by a high energy emission. Exposure of an analyte to an ionization source results in the formation of molecular fragments whose masses can be directly measured. The molecular weight of a substance is calculable following formation of the constituent molecular ion peaks. The mass of the ions formed lends to identification of the element through analysis of the mass-to-charge ratio, and the total number of ions formed is a reflection of the concentration.

A variety of known mass spectrometry systems and techniques are known, including time of flight mass spectrometry, quadrupole mass spectrometry, and ion cyclotron resonance mass spectrometry. For purposes of clarity, much of the present disclosure will be directed to ion cyclotron resonance mass spectrometry for comparison of RFI to other ionization sources. However, it is contemplated as within the scope of the present invention that RFI is equally applicable to other mass spectrometry techniques. Exemplary Fourier transform ion cyclotron resonance (FT-ICR) spectrometers contemplated as within the scope of the present invention include those described by Comisarow, et al. U.S. Pat. No. 3,937,955, the disclosure of which is hereby incorporated by reference in its entirety. See also "MASS SPECTROMETRY: Principles and Applications" (1996, John Wiley & Sons).

A wide array of mass spectrometry systems are known and each is designed and assembled with an eye toward balancing the perceived benefits and drawbacks of the various techniques and systems for performing each of: ion formation, mass separation, and detection. Achieving optimum analytical performance in mass spectrometry depends at least in part on the ionization method and performance thereof. Of the previously known ionization sources available, each suffers from challenges associated with the introduction of sample analytes causing increased background pressure, outgassing of electrical components during operation, delays due to the time required to replace electrical components damaged due to operation at high pressures, and, importantly the presence of chemical noise during analysis directly impacting the results and analysis. For example, electron impact ionization (EI) gives a high degree of fragmentation, yielding highly detailed mass spectra, however, EI is not suitable for coupling to high performance liquid chromatography (HPLC) systems, because, at atmospheric pressure, the filaments used to generate electrons burns out rapidly. In some embodiments, the present invention provides methods and systems that overcome one or more of these challenges.

By designing mass spectrometers that can determine the mass-to-charge (m/z) values accurately to four decimal places or more, it is possible to distinguish different formulas having the same nominal mass. Achieving optimum analytical performance in mass spectrometry depends at least in part on the efficiency of the ionization method. Generally, ionization methods are clustered into two major categories, hard and soft ionization approaches. Typically, hard ionization methods yield extensive ion fragmentation, while soft ionization methods tend to provide significantly less fragmentation. Exemplary hard ionization methods include: electron impact ionization, $^{252}$Cf desorption, and laser desorption. In some applications, hard ionization methods are advantageous because they offer additional functional group and structural information. However, often it is beneficial to avoid high ion fragmentation, to simplify the mass spectral complexities, and increase the signal-to-noise ratio for unknowns through the identification of intact molecular ions. Therefore, soft ionization methods such as chemical ionization (CI), field desorption, matrix-assisted laser desorption/ionization (MALDI), and electrospray ionization (ESI) are valuable methods to produce intact molecular ions of small molecules and/or macromolecular biopolymers.

As is described herein, RF energy can be used to provide of either hard ionization or soft ionization, in some embodiments, the type of ionization is determined by the degree of exposure to RF energy, for example, the length of time or range of frequencies and voltages an analyte is exposed to RF energy.

Radio Frequency Ionization

The present invention provides, in some embodiments, methods including the steps of applying radio frequency energy to a chemical compound so that at least one ion of the compound or of a compound fragment is generated, and detecting at least one such ion.

The present invention also provides, in some embodiments, methods of performing ionization including the steps of providing a chamber, introducing one or more chemical compounds to the chamber, applying radio frequency energy to the one or more chemical compounds so that at least one ion of the compound or of a compound fragment is generated, and detecting at least one such ion.

Any of a variety of chemical compounds/analytes may be used in accordance with provided methods and systems. As used herein, the term "chemical compound" means any substance consisting of two or more different chemical elements. Generally, any chemical compound that is susceptible to ionization with radio frequency energy is contemplated as within the scope of the present invention. In some embodiments, a chemical compound may be an organic (i.e. carbon containing) compound. Exemplary chemical compounds include, but are not limited to: petrochemicals and biological molecules (e.g., molecules derived or isolated from a living organism).

It is expected that provided methods and systems are compatible with a wide variety of chemical compounds/analytes in various states of matter. In some embodiments, the one or more chemical compounds is a solid. In some embodiments, the one or more chemical compounds is a liquid. In some embodiments, the one or more chemical compounds is a gas. Across various embodiments, RFI/FT-ICR MS can successfully generate ions from various classes of compounds, for example, small molecules, volatile polar compounds, non-polar compounds, halogenated organic molecules, very high molecular weight heavy petroleum/gas samples, complex biologics, proteins, peptides, lipids, electrically conducting species, electrically non-conducting species, ad electrically insulating species, among others.

Detection of ions generated according to provided methods may occur via any of the methods described herein including mass spectrometry. In some embodiments, the specific ion detector may include, without limitation, one or more of a Faraday cup or cylinder, an electron multiplier, and/or a photomultiplier or scintillation counter.

In some embodiments, the frequency of the radio frequency energy applied to a chemical compound in order to generate one or more ions may be any of a variety of frequencies. In some embodiments, the frequency of ionizing RF energy is between about 1 MHz and about 100 MHz, inclusive. In some embodiments, the upper bound is greater than 7.0 MHz. In some embodiments, the lower bound is below 4 MHz. In some embodiments, the frequency of the ionizing RF energy is between 2.0 MHz and 7.0 MHz, 4.5 MHz and 6.5 MHz, 5.0 MHz and 6.5 MHz, 5.5 MHz and 6.5 MHz, 4.0 MHz and 6.0 MHz, 4.0 MHz and 5.5 MHz, 4.0 MHz and 5.0 MHz, inclusive. In some embodiments, such range has a lower bound of about 2.0 MHz, about 3.0 MHz, about 4.0 MHz, about 4.5 MHz, about 5.0 MHz, about 5.5 MHz, about 6.0 MHz, about 10. MHz, about 12 MHz, about 12.5 MHz, about 13 MHz, or about 20 MHz and an upper bound of about 95 MHz, about 90 MHz, about 80 MHz, about 70 MHz, about 60 MHz, about 50 MHz, about 40 MHz, about 30 MHz, about 20 MHz, about 10 MHz, about 8 MHz, about 6.5 MHZ, or about 6 MHz, the upper bound being larger than the lower bound. In some embodiments, the frequency of the RF energy is greater than or equal to 1.0 MHZ. In some embodiments, the frequency of the RF energy is equal to or less than 100 MHz.

In some embodiments, the degree and/or type of ionization of the one or more chemical compounds may be determined by the length of time for which a particular chemical compound is exposed to RF energy. In some embodiments, RFI can provide both soft and hard ionization capabilities in one unit or ion source. In some embodiments, the degree of ion fragmentation can be controlled by changing the duration, frequency, and/or voltage of ionizing RF signal as well as electrode materials and distances.

In some embodiments, RF energy will be applied to one or more chemical compounds for between 0.01 millisecond and 5.0 seconds, inclusive. In some embodiments, the RF energy will be applied for between 0.01 and 2.5 seconds, 0.01 and 2.0 seconds, 0.01 and 1.5 seconds, 0.01 and 1.0 seconds, 0.01 and 0.5 seconds, 0.05 and 3.0 seconds, 0.05 and 2.5 seconds, 0.05 and 1.5 seconds, 0.05 and 1.0 seconds, 0.1 and 3.0 seconds, 0.1 and 2.0 seconds, 0.1 and 1.0 seconds, inclusive. In some embodiments, the RF energy is applied for 0.01 seconds or longer. In some embodiments, the RF energy is applied for 3.0 seconds or more. In some embodiments, such range has a lower bound of about 0.01 ms, about 0.1 ms, about 1.0 ms, about 10 ms, 0.05 s, about 0.1 s, about 0.5 s, about 1.0 s, or about 1.5 s and an upper bound of about 4.5 s, about 4 s, about 3.5 s, about 3 s, about 2.5 s, about 2.0 s, about 1.5 s, about 1.0 s, or about 0.5 s, the upper end being larger than the lower bound.

According to various embodiments, RF ionization may occur preferentially at a particular pressure or range of pressures. In some embodiments, the pressure at which ionization occurs may be an ultrahigh vacuum base pressure or near atmospheric. In some embodiments, the pressure is between about $1\times10^{-12}$ and $1\times10^{-3}$ torr. In some embodiments, such range has a lower bound of about $1\times10^{-11}$, about $1\times10^{-10}$, about $1\times10^{-8}$, about $1\times10^{-6}$, or about $1\times10^{-4}$, and an upper bound of about $1\times10^{-4}$, about $1\times10^{-5}$, about $1\times10^{-6}$, about $1\times10^{-8}$, about $1\times10^{-10}$, or about $1\times10^{-11}$, the upper bound being larger than the lower bound. In some embodiments, the partial pressure is equal to or greater than $1\times10^{-10}$ torr. In some embodiments, the partial pressure is less than or equal to $1\times10^{-5}$ torr.

The present invention also provides, according to various embodiments, ionization systems including a radio frequency (RF) source for providing power for production of ions, a chamber; a pair of trapping plates located within the chamber, wherein the pair of trapping plates define a first end and a second end of a cell, the first end trapping plate comprising at least one opening allowing passage of ions therethrough, and an ion guide assembly comprising at least one ion guide rod, wherein the ions are formed in a gap between an exposed end of the at least one ion guide rod and the first end trapping plate.

The present invention further provides, in some embodiments, methods for ionizing an analyte, including providing a pair of trapping plates located within a chamber, wherein the pair of trapping plates define a first end and a second end of a cell, the first end trapping plate comprising at least one opening allowing passage of ions therethrough; and applying a radio frequency (RF) signal to an ion guide assembly comprising at least one ion guide rod, wherein the ions are formed in a gap between an exposed end of the at least one ion guide rod and the first end trapping plate.

Provided methods and systems are contemplated as compatible with any RF source capable of producing RF energy at a frequency between about 1.0 MHz and 100.0 MHz.

In various embodiments, ionization will occur in a chamber, for example, an ion cyclotron resonance (ICR) cell. A variety of ion cyclotron resonance cells and other equipment are usable with the present invention, including, but not limited to, those described by Weller in U.S. Pat. No. 5,389,784, the disclosure of which is hereby incorporated by reference in its entirety. In some embodiments, a chamber may be a closed chamber wherein each side or end of the chamber is capable of restricting the flow of ions (i.e. "trapping" them) beyond a particular boundary. In some embodiments, one or more grids capable of accommodating an axial electric field is used to create a closed chamber. In some embodiments, a chamber may be an open chamber, wherein the flow of ions is allowed or facilitated through the chamber, such as in a particle accelerator. The chamber may be of any application appropriate shape. In some exemplary embodiments, a chamber may be a cylinder, a sphere, a cuboid, a cube, a hexagonal prism, or a triangular prism. In some embodiments, a chamber is a vacuum chamber.

In some embodiments, the chamber may contain a cell. In some embodiments, a cell is an ICR cell. In some embodiments, a cell may comprise a pair of trapping plates located within the chamber, wherein the pair of trapping plates define a first end and a second end of a cell, the first end trapping plate comprising at least one opening allowing passage of ions therethrough. In some embodiments, the trapping plates may be energized for purposes of confining ions during ion separation and detection. In various embodiments, a first end trapping plate provides separation between a first chamber from a second chamber. In some embodiments, a first chamber, also herein referred to as an ionization chamber, houses an RF ion source entrance, an analyte port, and an ion guide assembly. The second chamber, also referred to in some embodiments as an ICR cell, houses the FT-ICR MS, wherein separation and detection of the analyte ions occurs. In other embodiments, ionization may occur external to the chamber housing the ICR cell.

According to various embodiments and applications, an ion guide assembly comprises at least one ion guide rod. Any known ion guide assembly is contemplated as within the scope of the present invention including quadrupole, hexapole, and octopole assemblies. In general, an ion guide assembly comprising at least two ion guide rods will include ion guide rods that are substantially identical to one another. In some embodiments, ion guide assemblies including at least two ion guide rods will include ion guide rods varying in one or more of composition, length, or diameter. Ion guide materials could be any non-magnetic and conducting metal such as titanium, copper, gold, stainless steel, and others. Sizes and shapes could include any assembly appropriate for guiding ions.

According to various embodiments, the ion guide assembly may be a quadrupole ion guide (QIG) assembly. In some embodiments, the QIG assembly includes four metallic rods. Across various embodiments, the RFI signal bombards these rods. In some embodiments, ionization occurs when the rods transfer this energy to the analyte sample. In some embodiments, the ion guide assembly may comprise a single rod, two rods, six rods, or eight rods. In some embodiments, the ion guide assembly comprises more than eight rods. Additionally, in some embodiments, it is envisioned that the rods of the ion guide assembly do not have a cylindrical shape. Instead, the rods may be of a variety of shapes and sizes. For instance, the rods of the rod assembly may be oval, rectangular, square, or species of prism optimized for a particular geometry or optimized for ionization of analyte. While rods are typically manufactured from metals, other materials, such as coated ceramics or other conducting materials may be used in the RFI application.

Without wishing to be held to a particular theory, it is expected that RF ionization will occur in a space between the ion guide assembly and an ion trapping device, such as an ion trapping plate. Accordingly, in some embodiments, a gap will exist between the ion guide assembly and the first end trapping plate or metal electrodes. In some embodiments, the gap is between about 0.1 nm and about 4.0 mm, inclusive. In some embodiments, the gap is between 1.0 and 4 mm, 1.5 and 4.0 mm, 2.0 and 4.0 mm, 2.5 and 4.0 mm, 3.0 and 4.0 mm, 3.5 to 4.0 mm, 0.5 and 3.5 mm, 0.5 and 3.0 mm, 0.5 and 2.5 mm, 0.5 and 2.0 mm, 0.5 and 1.5 mm, or 0.5 and 1.0 mm, inclusive. In some embodiments, the gap is equal to or larger than 0.5 mm. In some embodiments, the gap is equal to or smaller than 4.0 mm. In some embodiments, such range has a lower bound of about 0.1 μm, about 1.0 μm, about 0.01 mm, about 0.05 mm, about 1.0 mm, about 1.5 mm, about 2.0 mm, or about 2.5 mm and an upper bound of about 4 mm, about 3.5 mm, about 3.0 mm, about 2.5 mm, or about 2.0 mm, the upper bound being larger than the lower bound In various aspects, the present invention provides a means of generating ions with very high efficiency. In some embodiments, a radio frequency signal is applied to the metal rods of a quadrupole ion guide (QIG) assembly. In some embodiments, the QIG is located in a high magnetic field near an ion cyclotron resonance cell of a Fourier transform ion cyclotron resonance mass spectrometer. In some embodiments, proximity of the analyte to the rods may produce RFI of the analyte near the ion cyclotron resonance cell between the quadrupole trapping plates and the end of the QIG rods.

In some embodiments, the present invention overcomes one or more existing challenges associated with using one or more existing ionization techniques. The major challenges associated with using existing ionization methods such as electron impact (EI), for the ionization of small molecules include: a high background pressure in the ICR cell due to the outgassing of the heated electrical components surrounding the ion energy source, for example, an EI gun, the presence of the chemical noise due to ionization of the outgassed materials, and downtime of the machine due to the need for the frequent replacement of fragile EI filaments that are normally placed within proximity of the ICR cell. Traditional sample ionization occurs at moderate pressures of about $1\times10^{-5}$ torr. These pressures may severely reduce the mass resolution and sensitivity of a mass spectrometry system. This is particularly true for analysis of volatile organic compounds.

In some embodiments, provided methods and systems may be used to determine the molecular formula of volatile organic compounds (VOCs, see, inter alia, Example 8). Such analysis has many analytical ("fingerprinting") applications in diverse disciplines including, but not limited to, disease biomarker detection, environmental sciences, explosive detection, forensics, and petroleomics. Currently, mass spectrometry (MS) is one of the most sensitive analytical techniques for VOC analysis. Accordingly, provided methods and systems may be used in accordance with mass spectrometry in order to enhance the analytical utilities of MS. Previously, chemical ionization (CI) and electron impact ionization (EI) have been among the most commonly employed ionization techniques for detection and structural analyses of VOCs and each brings along its own disadvantages.

In various implementations, RFI offers several advantages that overcome the challenges associated with the existing ionization methods that should make RFI an attractive option in mass spectrometry. For instance, in some embodiments, as shown in the examples below, RFI efficiencies and/or ion production efficiency were higher than the observed values with other methods.

In some embodiments, RFI is operated in the pulsed mode, and, therefore, while not intending to be limiting, it is believed that this approach does not produce the significant surface heating and the ensuing outgassing of the traditional ionization methods, such as EI. In various embodiments and in contrast to more traditional ionization methods, this reduced heating and outgassing offers lower background pressure and improved signal to noise. For example, in Fourier transform (FT) based mass spectrometers, such as FT-ICR and Orbitrap applications ultra-high vacuum is typically required for proper operation of high resolution mass spectrometers. In various implementations, RF pulses potentially can be quite short and this may have significant advantages when it is used with Time-of-flight (TOF) mass spectrometers, where high resolving power is desired. In some other embodiments, RFI can operate in a continuous wave mode.

Exemplary Operational Considerations and Methods

According to various embodiments, provided methods and systems may be used in conjunction with mass spectrometry. Practically, mass spectrometry can be separated into three phases: first, vaporization; second, ionization; third, mass separation; and finally, detection. A variety of mass spectrometry systems and techniques are known, including time of flight mass spectrometry, quadrupole mass spectrometry, and ion cyclotron resonance mass spectrometry. Provided below are some exemplary methods compatible with some embodiments of the present invention. These exemplary methods are intended to provide additional context around some embodiments and/or to illustrate how some embodiments may function.

Vaporization of the Analyte

Vaporization involves a phase change from a solid or liquid to a gas. If the analyte sample is not already in the gas phase, such a phase transition may be necessary for the analyte to move through a mass spectrometer. In various embodiments, gases and volatile liquid samples are introduced to the mass spectrometer chamber. In other embodiments, non-volatile solids or liquids may be directly introduced. In some embodiments, an analyte may be introduced into a mass spectrometry system through an aperture such as a port or opening functionally connected to an ionization chamber. In some embodiments, a vacuum is advantageous for vaporization of an analyte sample. In some embodiments, the vacuum continually displaces the volume whereby exploiting the equilibrium vapor pressure, the pressure exerted by a vapor of the analyte sample present in a thermodynamic equilibrium with its condensed phases (solid or liquid) at a given temperature, is a viable route for controlled introduction of liquids and solids.

Equilibrium vapor pressure indicates the evaporation rate, that is, it relates to the tendency of gas phase particles to escape from a liquid or a solid. At a given temperature, the higher the vapor pressure, the more volatile the substance. Vapor pressure typically increases non-linearly with temperature. As the temperature increases, the vapor pressure of a target analyte sample may be enough to form vapor inside the bulk of the substance. The partial pressure of a target analyte is that of a single component within the total pressure of the system. In mass spectrometry systems, vacuum is also important so that the analyte may freely move from an analyte introduction region through the mass spectrometry system. Free movement improves the likelihood that the analyte will reach the detector without interacting with or reacting with air molecules, hitting the wall, or being lost to the vacuum.

Ionization in Mass Spectrometry

Typically, following vaporization, the vaporized analyte can pass into the ionization chamber, where in some embodiments, an analyte sample is bombarded by a high energy emission. In some embodiments, the analyte sample is ionized either by removing one or more electrons from the atom, resulting in a positive ion, or by adding an electron resulting in a negative ion. In some embodiments, the ionization source generates the analyte ions in an external ionization chamber and the ions are injected into a chamber or cell for ion separation and detection. In some other embodiments, the ionization source generates the analyte ions inside the ion separation chamber or cell.

In various embodiments, an ionization source may provide enough energy to remove an electron from an atom of an analyte forming a positive ion, a parent ion. In some other embodiments, residual ionization energy may cause a molecular ion to fragment into neutral pieces and/or smaller fragment ions. In other embodiments, energetically unstable ions can break up into smaller pieces. For example, a positive ion and an uncharged free radical. While this ion fragment can be detected, the uncharged particles are often lost to the vacuum. For large molecules, an infinite number of possible fragmentations are possible. Therefore, resultant charged species of the analyte include ions, molecular fragments, and molecular fragment ions.

In some aspects of the present invention, an ionized analyte may be guided towards the detector. An ion repeller is a plate that can be biased to carry a slightly positive or slightly negative charge. Positive analyte ions are repelled by a positive ion charge applied to the plate and negative ions are repelled by a negative charge applied to the plate. The result of supplying this bias is to provide some directionality marshaling the ions through to the rest of the mass spectrometry system. In some embodiments, the analyte ions are accelerated such that they all have the same kinetic energy. In some embodiments, a series of entrances can focus the ions into a fine beam.

Detection

Typically a magnetic field is used to mass separate charged species present in a complex mixture of analytes. In various implementations, for example, in ion cyclotron mass spectrometry, ions that have been shepherded into the separation region via an ion guide are drawn to a magnetic field running lengthwise through the cell. As the ions enter and interact with the magnetic field, they begin to circle perpendicular to the field. Ions traveling in magnetic fields are confined to these circular orbits by the Lorentz Force. The radius of this orbit is about the same for all ions. But, the speed at which these ions travel is not.

In general, the speed of travel of various ions is known as the cyclotron frequency. The speed of travel causes analyte ions to be differentially deflected by a magnetic field. The extent the ions are deflected by the magnetic field is a function of the mass of the ions and charge of the ions. The amount of deflection depends on the ion mass. The magnetic field deflects ions having a lighter mass by a greater amount than ions having a heavier mass. The amount of deflection also depends on the degree of charge. The degree of charge is dependent upon ionization and the ionization source. If an ion source generates ions with multiple electrons added or removed, that is a positive ion with a charge of at least +2 or a negative ion with a charge of at least −2, then at least a doubly charge species is formed. The magnetic field will deflect an ion with more charge by a greater amount when compared to the deflection of an ion possessing a lesser charge. Thus, the degree of separation is dependent on mass and charge, which when combined are evaluated during spectral analysis as the mass/charge ratio (m/z).

After the beam of ions is separated and grouped according to the mass/charge ratio, these separated ions having similar mass to charge ratio are grouped and may pass through to the detector of the mass spectrometry system. In various embodiments, the magnetic field strength is varied in intensity. When varied, the extent of deflection caused by the stronger or weaker field is also varied. For instance, in magnetic sector analyzers, by varying the field strength, some ions at a specific mass/charge ratio may be preferably selected to reach the detector, while others are deflected to the wall of the chamber. For example, in embodiments with a high magnetic field strength, ions having lighter mass and/or higher charge are most deflected. In some embodiments the path to the detector travels via a curved tube. In some embodiments, ions that do not reach the detector collide with the walls.

Upon hitting the wall, the ions will typically either pick up or lose charge by adding or removing an electron. These neutral species are then removed by the vacuum pump. Ultimately, by varying the magnetic field, in some aspects of the invention each ion stream possessing a particular mass to charge ratio is directed to the detector in turn. That is, by varying the strength of the magnetic field, ions of different mass can be focused progressively on the detector. In some embodiments, a detector is comprised of detector plates that detect the ions via electrodes electrically connected between the plates.

In some embodiments, an oscillating radio frequency pulse is sent to the plates. Each ion responds to a particular frequency corresponding to its particular cyclotron frequency. The pulse may be scanned from low to high frequency. Heavier ions tend to respond to low frequency, and, therefore, are detected first. Ions in proximity to the electrodes induce a flow of negatively-charged electrons, a current, that may be measured. The mass/charge of each ion being detected is related to its natural cyclotron frequency and the magnetic field used for ion trapping. The image current detector produces a current which is proportional to the number of ions arriving. In some embodiments, the ions are electrically detected. In various embodiments, a flow of electrons in the wire of an electrical detector is detected through an electric current. The more ions arriving, the greater the current. In various embodiments, the detector apparatus and system can amplify and record this current. A Fourier transform may be used to convert the data from a signal defined by amplitude over time to a signal that separates out and depicts the spectrum of all the signals received. A Fourier transform shows the amplitude of each of the detected frequencies. The amplitude corresponds to the number of ions associated with that frequency.

Spectral Output and Analysis

Ultimately, a signal generated during ion detection is transformed into a spectral output, a mass spectral pattern, that may be interpreted. In a mass spectrum, each peak represents a type of atom or molecule. As typically presented, mass-to-charge ratio (m/z) runs along the x-axis, and the height of the peaks tell us how many of a particular species there are. A peak and peak intensity at each mass-to-charge ratio (m/z) correlates to the Fourier transform of the detected signal which is related to the number of ions present. Spectral patterns may be generated for a parent ion or product fragments. Based on the m/z of a peak, the possibilities of fragments that comprise the peak may be identified and correlated to the elements, compounds, and molecules they represent. Ion fragmentation patterns are fingerprints. Each pattern provides information regarding the structure and its abundance within the analyte. For instance, even though two distinct molecules have the same molecular mass, differing structures can generate different ion fragmentation mass spectral patterns. The elemental and molecular composition of the analyte may be determined through identification by associating the mass/charge of the spectral output with the ions, molecular fragments, and molecular fragment ions and correlating those to an element or molecule within analyte. Additionally, integration of the number of charged species detected and correlated to an element or molecule reflects its concentration within the mixture of analytes.

According to various embodiments, RFI improves ion production capability and signal to noise ratio. Each atom has a distinct atomic mass (also called atomic weight), which is a function of the number of its protons and neutrons. The atomic mass listed on the periodic table is a weighted average of the masses of all the naturally occurring isotopes of a chemical element, that is, atoms of the same element that vary in the number of neutrons in their nuclei, and hence in mass. According to some embodiments, RFI/FT ICR MS affords the capability to produce sufficient number of ions and use mass spectrometer to resolve the difference between masses of two isotopes or two molecules. A blur in a broadband spectrum may be broken down into individual, discernible peaks using RFI/FT ICR MS. Such sensitivity is not available with other ionization techniques with equivalent detection capabilities. In some implementations, RFI/FT-ICR can accurately determine masses at least five figures past the decimal point over a vast spectrum of different analytes. In various embodiments, higher resolving power enables analysis of up to several hundred kilodaltons.

EXAMPLES

Example 1

Exemplary RFI System and Method

In this example, a simple exemplary system 100 and method of RFI ionization of an analyte sample is described and shown in FIG. 1. An RF source, not shown, emits an RF signal, 108. The RF signal, 108, interacts with the quadrupole ion guide rods, 102. Ionization of an analyte occurs in a gap, 106, between the exposed ends of the quadrupole ion guide rods, 102, proximal to the ICR cell front end trapping plate, 104. In some embodiments, there is an opening 110 between the ionization region and the ICR cell on the face of the front end trapping plate, 104. In various embodiments, the opening 110 may be a circular aperture. In some embodiments, the opening may be a slit. In still other embodiments, the opening could be of various shapes and sizes depending on the structure and geometry of the system and the nature of the analyte.

Example 2

Experimental Conditions and Ionization of Acetone

Unless otherwise specified, in each of the following Examples, two different 9.4 tesla FT-ICR MS instruments were used (former IonSpec Corp.—now a division of Agilent Technologies, CA) (viz., GC/FT-ICR and ESI/FT-ICR mass spectrometers). These two ESI/FT-ICR MS and GC/FT-ICR MS instruments shared a 9.4 tesla superconducting magnet (Cryomagnetics Inc., TN) and both were equipped with similar cylindrical ICR cells, QIG assemblies, and the EI/CI capabilities. The initial and systematic RFI studies were conducted using the GC/FT-ICR MS system; subsequently, the original MS results were confirmed/reproduced by using RFI with the ESI/FT-ICR MS instrument.

A systematic study of the RFI process and analysis of the MS results showed that the RFI-generated ions were formed "off-axis" and radially away from the center of the ICR quadrupole trapping plate (QTP) (data not shown). To confirm the "off-axis" ion generation, trapping parameters sufficient to guide the ions into the ICR cell through various small circular entrance apertures were used. Unless otherwise specified, the diameter of the entrance apertures was ~0.4 cm, positioned ~2 mm away (axially) from the QIG rods.

FIGS. 2A, 2B, 3A and 3B (left and middle panels) show the schematic views of the QTP plates with different positions of the trapping plate ion entrance openings (circular apertures) into the ICR cell, and the position of the QIG rods with respect to the QTP. The corresponding RFI/FT-ICR mass spectra are shown to the right of each pictorial representation in FIGS. 2C and 3C. Seven sets of experiments were conducted to evaluate the ion entrance/generation positions using the various configurations of modified QTPs. After replacing the original QTP with each of the modified plates, a series of the RFI/FT-ICR mass spectra were collected and subsequently inspected for the presence or absence of the representative ions for acetone (or any background ion). For each of the seven experiments, we also acquired internal EI mass spectra (after positioning each of the QTP plates) to ensure the integrity of all electronic connections on the ICR cell for ion signal detection. We also collected various "method blanks" by (a) turning the RF signal "off", (b) turning the EI gun and ionization gauge signals "off", and (c) not introducing any analyte during the RFI experiments. All of the "method blank" experiments yielded noise spectra confirming the ion generation via RFI.

Figures 2A, 2B, 2C:
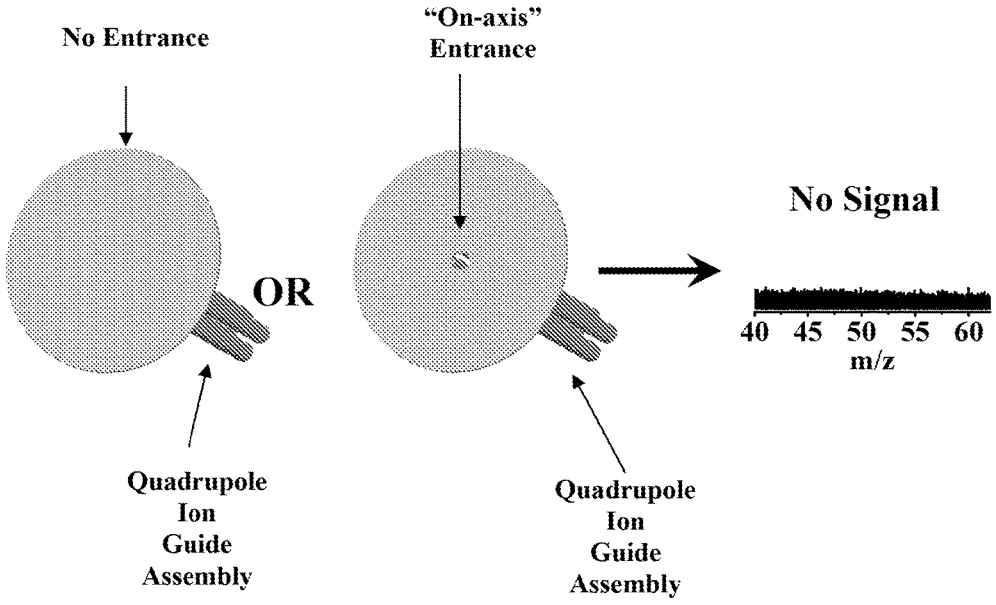
FIG. 2A depicts a schematic representation of an ion cyclotron resonance cell, wherein the quadrupole trapping plate does not contain any openings to quadrupole ion guide rod assembly.
FIG. 2B depicts a schematic representation of an ion cyclotron resonance cell, wherein the quadrupole trapping plate has only a single on-axis opening to the ion cyclotron resonance cell, wherein on-axis means aligned with a central axis of the ion guide assembly.
FIG. 2C shows an exemplary RFI/FT-ICR mass spectra for acetone generated using an ion cyclotron resonance cell of either the configuration of FIG. 2A, wherein the quadrupole trapping plate does not have an opening to the cell, or the configuration of FIG. 2B, wherein the quadrupole trapping plate has only a single on-axis opening to the cell.

When the Al plates serving as the FT-ICR MS trapping plates had no opening into the ICR cell or had only a single central "on-axis" entrance window open into the ICR (FIGS. 2A and 2B, respectively), no acetone (or any background) ion signals were observed in the mass spectrum (FIG. 2C). These MS experiments suggested that either ions were not formed near the center of the QIG assembly or if they were formed, these ions could not be transferred into the ICR cell.

Figures 3A, 3B, 3C:
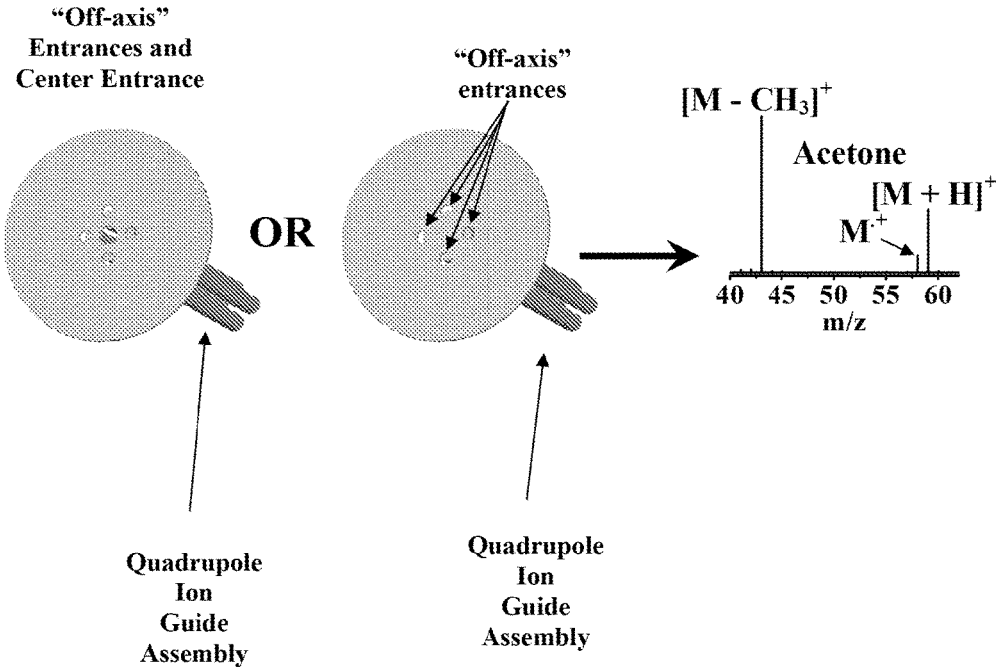
FIG. 3A depicts a schematic representation of an exemplary ion cyclotron resonance cell, wherein the quadrupole trapping plate includes a center opening and four off-axis openings to the quadrupole ion guide rod assembly.
FIG. 3B depicts a schematic representation of an exemplary ion cyclotron resonance cell, wherein the quadrupole trapping plate includes only four off-axis openings to the quadrupole ion guide rod assembly.
FIG. 3C shows an exemplary RFI/FT-ICR mass spectra for acetone generated using an ion cyclotron resonance cell of either the configuration of FIG. 3A or the configuration of FIG. 3B.

FIGS. 3A and 3B show the schematic views of the Al plates with either all five windows (i.e., four "off-axis" holes across each of the quadrupole rods and one central/"on-axis" hole) or only the four "off-axis" windows open to the ICR cell, respectively. Note that for the experiments involving the use of "off-axis" openings, besides conducting experiments with all four "off-axis" windows open, in four separate and additional experiments the other three "off-axis" entrances were blocked except for one of the windows.

For all six sets of the FIG. 3A experiments (configurations: (a) all five windows unblocked or open, (b) only the central/"on-axis" window blocked and all four "off-axis" windows open, (c) single entrance experiments with only one of the "off-axis" windows unblocked (total of four experiments)), RFI-generated ions from acetone at m/z values of 43 (a major fragment ion, $[M-CH_3]^+$) ($M.^+$), and 59 ($[M+H]^+$ or the self-CI product of acetone) were detected as shown in FIG. 3C. The RFI/FT-ICR mass spectra acquired with all of the five QTP entrances open into the ICR cell showed two fold increased S/N as compared to the RFI/FT-ICR mass spectra acquired with QTPs with a single "off-axis" entrance window open.

Without wishing to held to a particular theory, the mass spectral results shown in FIGS. 2C and 3C suggest that the potential location(s) for ion generation in RFI is between the QIG rod ends and QTP but not inside the ICR cell or in the inscribed space between the QIG rods. Moreover, the MS results implied that the potential positions for ion entrance into the ICR cell were "off-axis" and within the spacing between the QTP openings and QIG endings. This assumption is supported by the additional experimental observations such as the asymmetric shape of time domain transient signal (data not shown) and the observed peak splitting which we eliminated by using a wire ion guide (WIG) device positioned inside the ICR cell.

The acquisition of the RFI/FT-ICR mass spectra using the "off-axis" entrances of the ICR cell QTP (FIGS. 3A and 3B) were associated with three non-ideal challenges. The first challenge was the presence of the peak splitting and side bands in the acquired RFI/FT-ICR mass spectra. The second challenge was the failure to trap the ions inside the ICR cell for longer than 1 s (i.e., trapped ions (and/or the ensuing) signals were lost shortly after their introduction into the ICR cell). The third challenge was associated with the necessity to use (optimized) asymmetric electrical potentials on the ICR cell trapping plates for efficient trapping of the RFI-generated ions (e.g., QTP voltage of 30 V and filament trapping plate (FTP) voltage of 0.0 V). To overcome the three aforementioned challenges, we used a WIG device.

Figure 4:
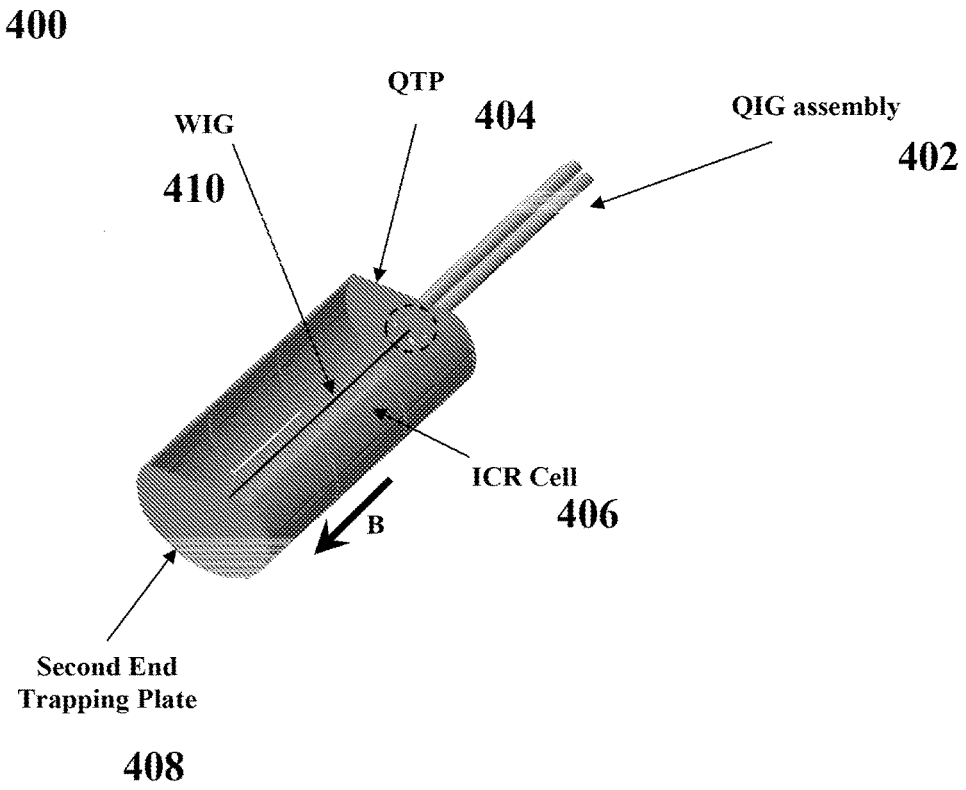
FIG. 4 shows a schematic representation of an exemplary cylindrical ion cyclotron resonance cell with a wire ion guide positioned between the first (quadrupole or QTP) and second (filament or end) trapping plates of the cylindrical ion cyclotron resonance cell.

FIG. 4 shows a schematic view of the ICR cylindrical cell and the "on axis" position of the WIG (shown with red solid line) inside the ICR cell. The far ends of the 15-cm long copper WIG (diameter ~200 μm) were each attached to the center of one of the two end trapping plates of the ICR cell using ceramic washers (for electrical isolation) and two sets of brass screws and nuts. The existing electrical connections and DAC pulse of the electron gun filament (from the Omega 8.0 software, IonSpec Corp.) were used to apply/control the voltage on the WIG.

Figure 5A:
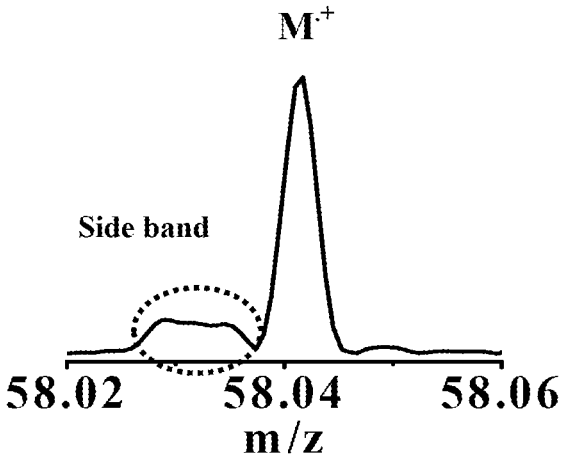
FIG. 5A shows an exemplary RFI/FT-ICR mass spectrum of acetone acquired without using a wire ion guide positioned between the first and second trapping plates during off-axis ion introduction.
Figure 5B:
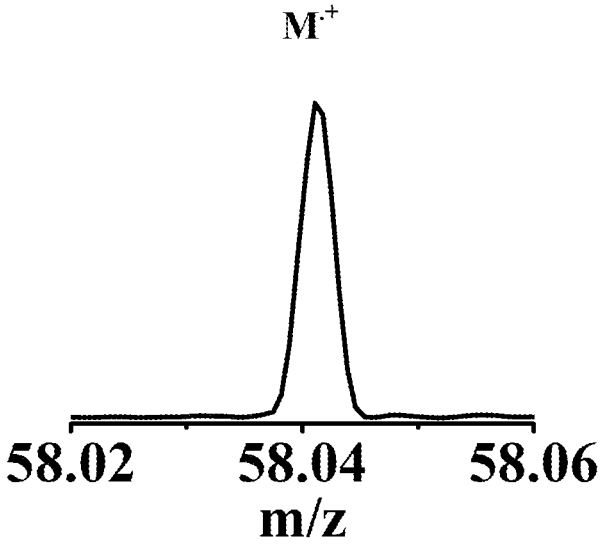
FIG. 5B shows an exemplary RFI/FT-ICR mass spectrum of acetone acquired using the wire ion guide positioned between the first and second trapping plates during off-axis ion introduction.

FIGS. 5A and 5B contain expanded views of the m/z range from 58.02 Th to Th−58.06 Th for RFI/FT-ICR mass spectra of acetone acquired without (FIG. 5A) and with the WIG (FIG. 5B). The mass spectral peak for $M.^+$ species from acetone (m/z 58.0413 Th) in FIG. 5A shows the presence of a side band at smaller m/z value (i.e., peak labeled as "side band" and marked with the dotted ellipse in FIG. 5A); this side band disappears when the WIG is used to guide the ions towards the center of the ICR cell (FIG. 5B).

To acquire the RFI/FT-ICR mass spectrum of acetone using the WIG, the DC voltage on the WIG was initialized to the optimized value of −17 V and then pulsed to 0.0 V during the ion excitation and detection events. The use of a WIG eliminated the observed side bands from the RFI/FT-ICR mass spectrum (FIG. 5B). In addition, by using the WIG, the RF-generated ions could be trapped inside the ICR cell for longer periods (e.g., >20 s, as compared with the maximum possible trapping time of 1 s without the use of WIG). The enhanced quality of the RFI/FT-ICR mass spectra acquired in the presence of a WIG confirmed our observations in FIG. 3C, suggesting the "off-axis" generation and entrance of the RFI generated ions. Moreover, with the use of the WIG device, the RFI-generated ions could be trapped inside the ICR cell by applying "normal" symmetric (rather than asymmetric) electrical potentials on the ICR cell trapping plates.

In an attempt to generate ions "on-axis", two rhenium ribbons (Scientific Instrument Services Inc., NJ, 99.97% purity, each piece 10 mm long, 0.76 mm wide, and 0.038 mm thick) were spot welded on one of the quadrupole rods and the other on the central opening of the original QTP. The rhenium ribbon welded to the quadrupole rod was extended inward and its tip was at the exact center of the "on-axis" opening aperture of QTP and −2 mm away from the welded rhenium ribbon to the QTP. Only by using this new setup we were able to observe MS signals with having only the central/"on-axis" window open (data not shown).

Figure 6A:
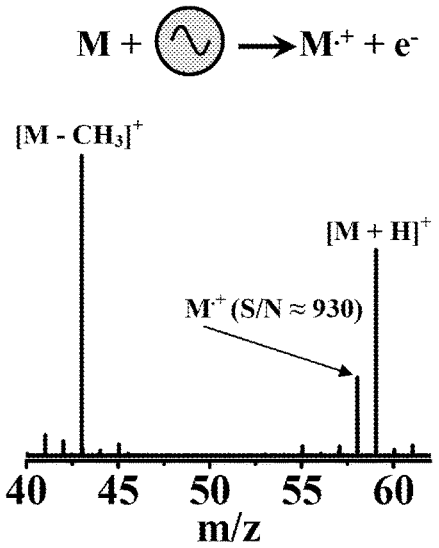
FIG. 6A shows an exemplary RFI/FT-ICR mass spectra of acetone with an ionization pulse time duration of 900 ms and frequency of 6.5 MHz about 200 $V_{bp}$.

The FT-ICR mass spectra of acetone generated using RFI was compared to that using EI. The RFI/FT-ICR MS (FIG. 6A) and EI/FT-ICR MS (FIG. 6B) of acetone showed comparable patterns. To acquire the mass spectrum shown in FIG. 6A, an RF signal with a frequency of 6.5 MHz (−200 $V_{bp}$), for the duration of 900 ms, was applied on the QIG rods. To acquire the mass spectrum shown in FIG. 6B, the EI electron energy and ionization time duration were set at 70 eV and 900 ms, respectively. To improve the EI signal, the maximum allowed EI current was used (increasing the current beyond the maximum current caused excessive ICR cell heating and outgassing which deteriorated the analyte signal). For both RFI and EI experiments, acetone molecules were pulsed into the vacuum chamber from a reservoir containing acetone vapor (at an inlet pressure of −7.0 torr). The instantaneous highest acetone pressure in the vacuum chamber after the (2 ms) acetone pulse was ~$1.0\times10^{-7}$ torr (the background ICR cell pressure was ~$1.0\times10^{-9}$ torr).

Figure 6B:
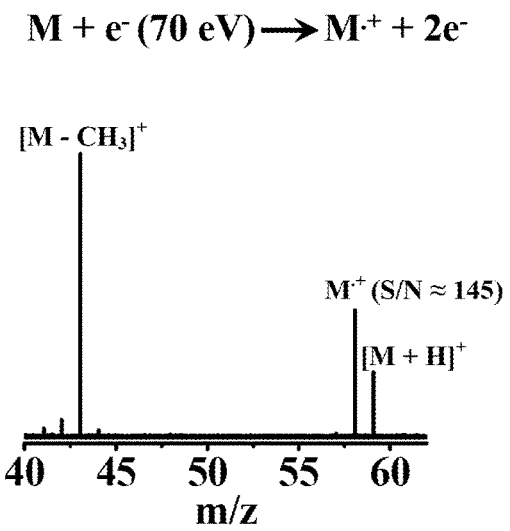
FIG. 6B shows an exemplary EI/FT-ICR mass spectra of acetone with an ionization pulse time duration of 900 ms and electron energy of 70 eV.

The RFI/FT-ICR mass spectrum of acetone (M) (FIG. 6A) shows the presence of acetone fragment ions ($[M-CH_3]^+$ m/z 43 Th), molecular ions ($M.^+$, m/z 58 Th), and the self-CI protonated molecular ions ($[M+H]^+$, m/z 59 Th) and is similar to the acetone EI/FT-ICR mass spectrum (FIG. 6B). Under the identical ionization time duration of 900 ms and acetone highest partial pressures of −$1.0\times10^{-7}$ torr (i.e., 2 ms acetone pulse), the RFI mass spectrum of acetone (with all four "off-axis" windows open) showed ~6.0 fold enhanced S/N ratio as compared to the EI mass spectrum of acetone. For instance, the S/N ratio for $M.^+$ peak of acetone in RFI/FT-ICR (FIG. 4*a*) and EI/FT-ICR (FIG. 4*b*) mass spectra were ~930 and ~145, respectively.

Figure 7:
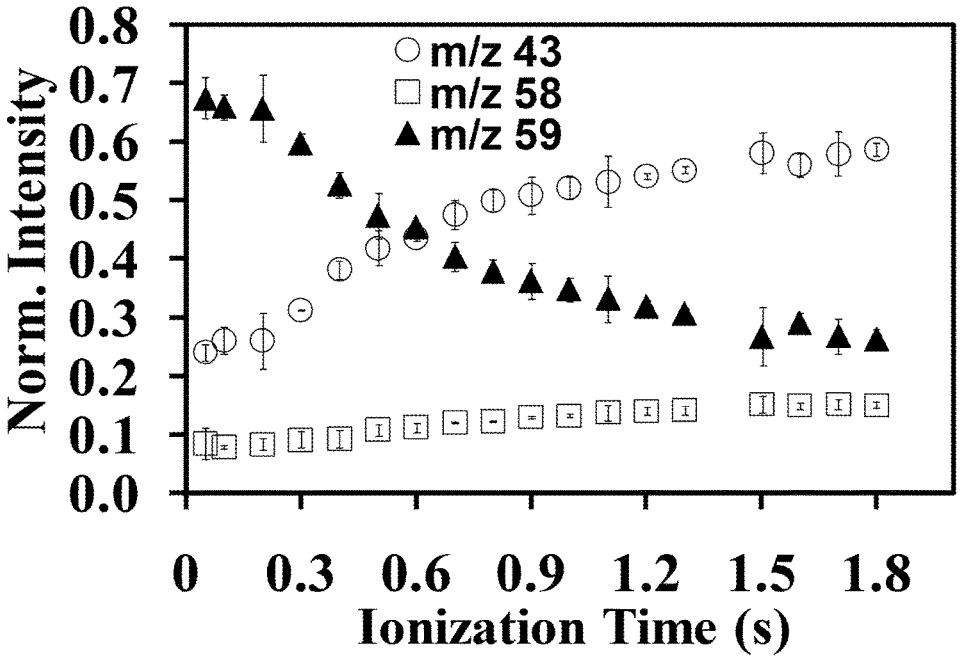
FIG. 7 depicts a graph of RFI operating conditions that can yield mass spectra resembling either hard and/or soft or chemical ionization (CI) outcomes.

The extent of ion fragmentation in RFI could be controlled by adjusting the RFI ionization time duration and ion formation via chemical ionization. In other words, RFI can be operated as both "soft" and "hard" ionization methods by adjusting the CI reaction time and time duration of RF signal on the QIG rods. FIG. 7 shows the plot of normalized ion intensity of m/z 43 Th (i.e., $[M-CH_3]^+$ empty circle (o) symbols), molecular radical cation ($M.^+$, m/z 58 Th, empty square (□) symbols), and protonated molecular ion ($[M+H]^+$, m/z 59 Th, filled triangle (▲) symbols) versus the RFI ionization time (in the range of 0.01 s to 1.8 s), respectively. The appearance of the RFI mass spectra depended on the ionization time duration. For example, by increasing the RFI ionization time from 0.05 s to 1.8 s, the $[M+H]^+$ (m/z 59) ion abundance decreases but the ion abundance for $[M-CH_3]^+$ (m/z 43) increases (e.g., the normalized intensity of m/z 43 Th ($[M-CH_3]^+$) increased from 24 (±1) % to 60 (±1) %). Without wishing to be held to a particular theory, these results suggest enhanced ion fragmentations as a function of RFI period.

Example 3

Ionization of Semi-Volatile Silicone Polymers

In this example, the broad applicability of RFI is demonstrated. Specifically, in this Example, RFI/FT-ICR mass spectrum were acquired for semi-volatile silicone polymers. Unless otherwise specified, the conditions used are as described in Example 1 for the analysis of acetone.

Figure 8:
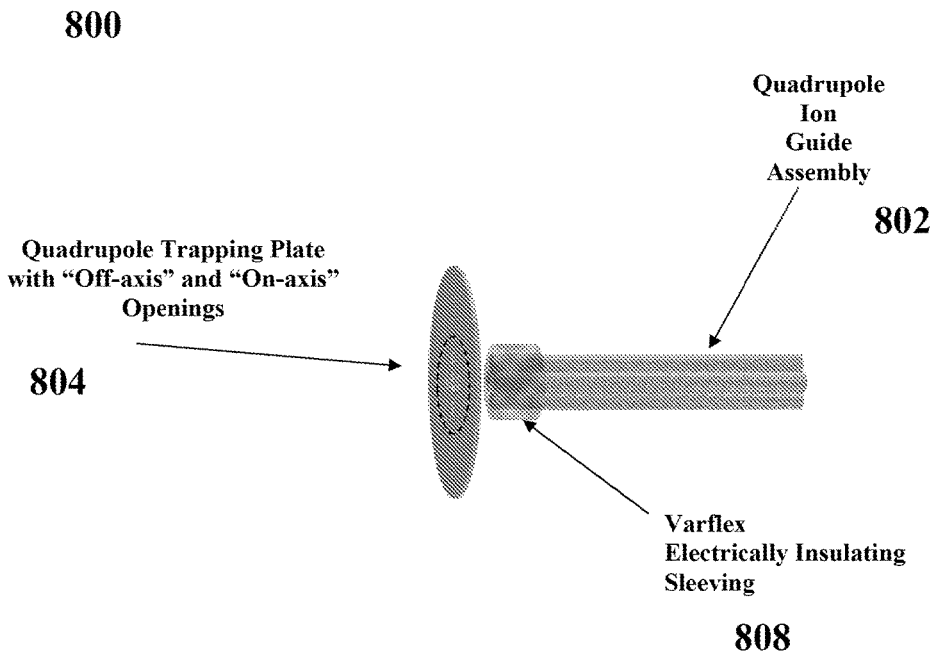
FIG. 8 depicts an exemplary schematic view of an insulating sleeve positioned on the end of the quadrupole rods proximal to quadrupole trapping plate including four off-axis openings and one on-axis opening.

A 2 cm×about 2 cm piece of Varflex electrical insulating sleeve, type 5 (Varflex Corp., NY), made of silicon elastomers, a was placed on the end terminal of the QIG assembly, 902, to cover all four rods in the proximity of the ICR cell QTP, 904. FIG. 8 depicts the position of the insulating sleeving, 908, on the QIG rods, 902. To acquire an RFI/FT-ICR mass spectrum of the silicone polymers, about of type 5 Varflex electrical insulating sleeving materials, 908, were.

Figure 9B:
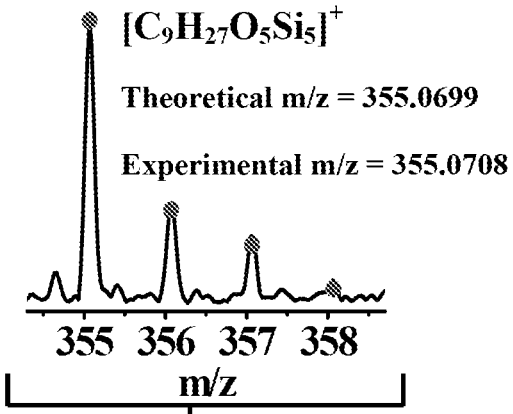
FIG. 9B shows an exemplary RFI/FT-ICR mass spectrum of the PDMS compounds shown in 9A, having an expanded view of the spectra between 354 m/z and 359 m/z.
Figure 9A:
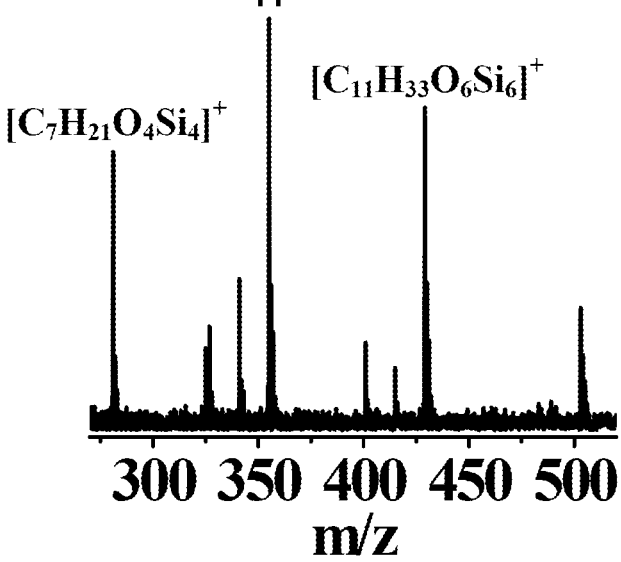
FIG. 9A shows an exemplary RFI/FT-ICR mass spectrum of cyclic poly dimethyl siloxane (PDMS) compounds of a type 5 Varflex electrically insulating sleeve.

FIG. 9A shows the RFI/FT-ICR mass spectrum acquired after the placement of the insulating sleeving. The assigned MS peaks (e.g., $C_7H_{21}OP_4Si_4$+ (m/z about 281.0509 Th), $C_9H_{27}O_5Si_5$+ (m/z 355.0708 Th), and $C_{11}H_{33}O_6Si_6$+ (m/z 429.0879 Th)) with an average mass measurement accuracy of about 1.7 ppm indicate the presence of cyclic poly (dimethylsiloxane) (PDMS) compounds. To confirm the peak assignments, the experimental isotopic patterns of the species assigned as $C_7H_{21}O_4Si_4^+$, $C_9H_{27}O_5Si_5^+$, and $C_{11}H_{33}O_6Si_6^+$ were compared with their corresponding theoretical isotopic patterns. FIG. 9B, an expanded view of the of the identified mass spectral region of FIG. 9A, shows the experimental isotopic pattern of the species at m/z 355.0708 Th matches with the theoretical isotopic pattern calculated based on the experimentally collected MS with mass resolving power ($m/\Delta m_{50}$%) of about 3000 for the assigned species as $C_9H_{27}O_5Si_5^+$ (identified by the filled circles).

Example 4

Ionization of Heptatriene

Figure 10:
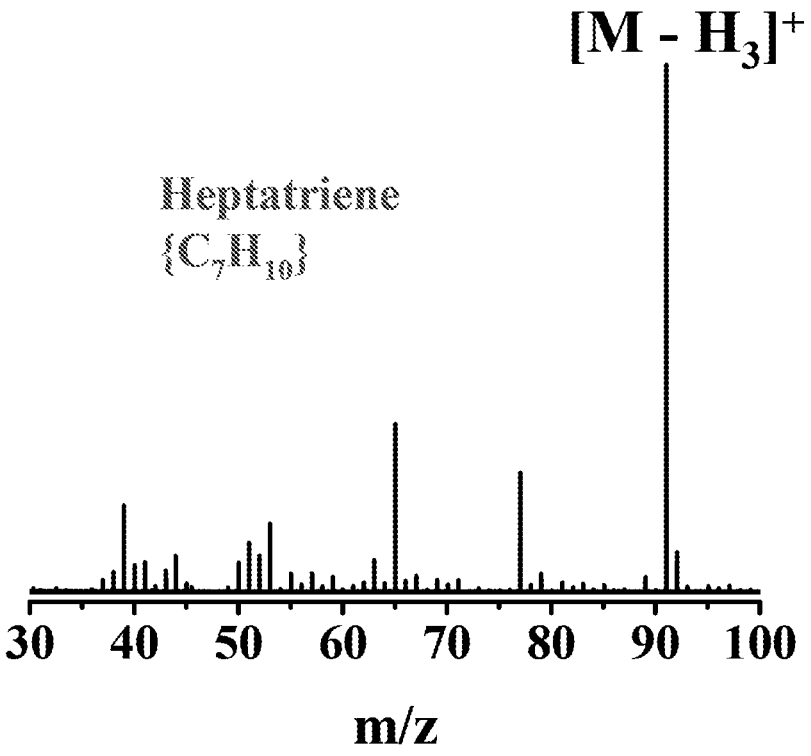
FIG. 10 shows an exemplary RFI/FT-ICR mass spectrum of heptatriene generated according to certain embodiments.

In this example, the RFI/FT-ICR mass spectra of heptatriene ($C_7H_{10}$) was assessed according to the methods described for Example 1, using RFI parameters 6.5 MHz, about 200 $V_{bp}$, and 500 ms ionization time, and analyzed. FIG. 10 shows the resultant RFI/FT-ICR mass spectrum of heptatriene.

Example 5

Ionization of Chlorodibromomethane

Figure 11:
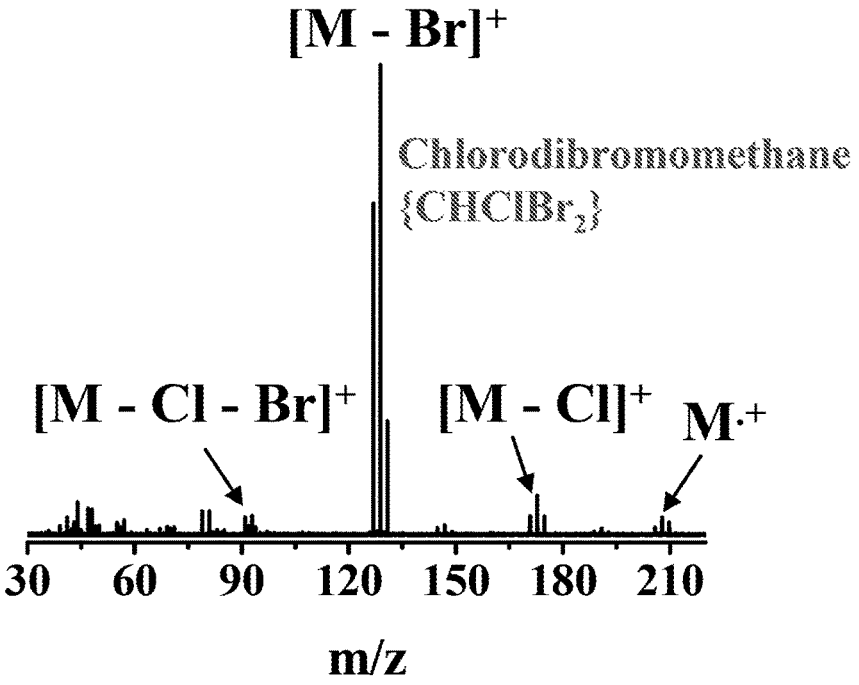
FIG. 11 shows an exemplary RFI/FT-ICR mass spectrum of chlorodibromomethane generated according to certain embodiments.

In this example, the RFI/FT-ICR mass spectra of chlorodibromomethane ($CHClBr_2$) was assessed according to the methods described for Example 1, using RFI parameters 6.5 MHz, about 200 $V_{bp}$, and 500 ms ionization time, and analyzed. FIG. 11 shows an RFI/FT-ICR mass spectrum of chlorodibromomethane.

Example 6

Ionization of Perfluorotributylamine

Figure 12:
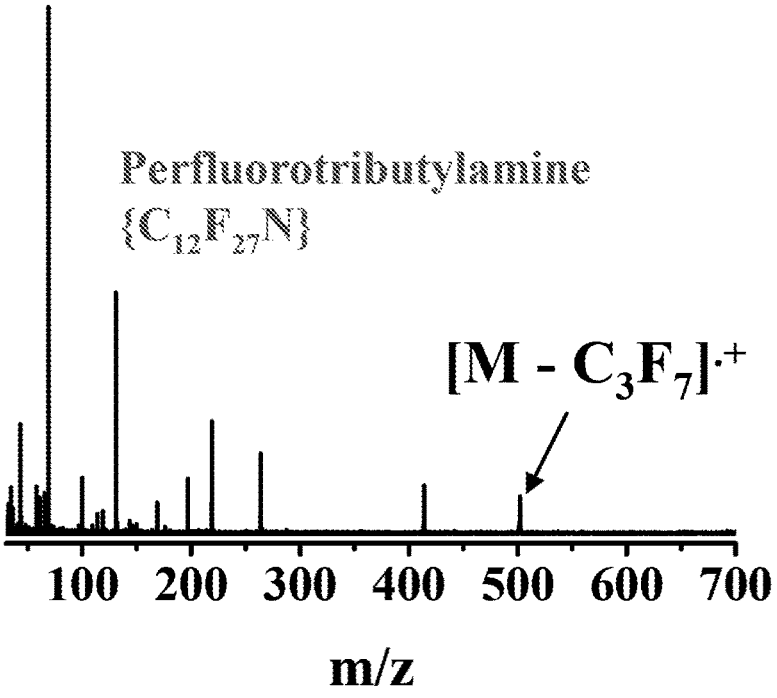
FIG. 12 shows an exemplary RFI/FT-ICR mass spectrum of perfluorotributylamine generated according to certain embodiments.

In this example, the RFI/FT-ICR mass spectra of perfluorotributylamine ($C_{12}F_{27}N$), was assessed according to the methods of Example 1, using RFI parameters 6.4 MHz, about 200 $V_{bp}$, and 1 s ionization time, and analyzed. FIG. 12 shows the resultant RFI/FT-ICR mass spectra of perfluorotributylamine.

Example 7

Ionization of a Volatile Hydrocarbon Mixture

Figure 13:
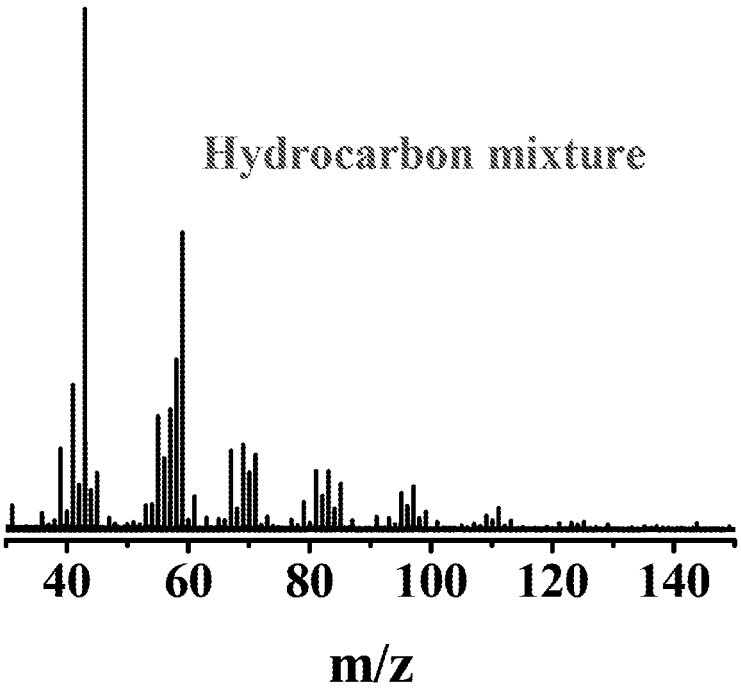
FIG. 13 shows an exemplary RFI/FT-ICR mass spectrum of a hydrocarbon mixture generated according to certain embodiments.

In this example, a volatile hydrocarbon mixture was introduced and ionized using RFI parameters 6.4 MHz, about 200 $V_{bp}$, and 1 s ionization time. FIG. 13 shows the resultant RFI/FT-ICR mass spectrum of the volatile hydrocarbon mixture. RFI is capable of unbias ionization of all of the components in the hydrocarbon mixture.

Example 8

Ionization of a Bio-Oil

In this example, the utility of RFI/FT-ICR for rapid "sampleprinting" of, in this Example, volatile organic compounds (VOCs), is described. In this Example, the analyzed samples included room temperature VOCs of aqueous and oily phases of a bio-oil sample derived from slow pyrolysis of pine shavings' biomass and a commercially available gasoline sample (research octane number of 87). The example demonstrates the potential for using RFI in combination with the high mass measurement accuracy and high mass resolving power of FT-ICR MS to enable the identification of headspace volatile organic compounds (VOCs). This example also shows that the degree of analyte oxygenation can be used for sample differentiation, at least in some cases.

Sample Preparation

The pine shavings (PS) bio-oil samples were prepared by slow pyrolysis in a custom-built reactor such as those described in LeCroy et al., Nitrogen, biochar, and mycorrhizae: Alteration of the symbiosis and oxidation of the char surface, Soil Biol. Biochem., 2013, 58, 248-254, the disclosure of which is hereby incorporated in its entirety. Approximately 1,695 g of PS (biomass) was heated in an air-tight, 20-liter, stainless steel reaction vessel for 400 minutes. Pyrolysis temperature programming was: 30 minutes at 100° C., ramp at 6° C./minute to 470° C., 60 minutes at 470 to 490° C., and cooling at 4° C./minute to ambient temperature. Bio-oil condensation was accomplished by cooling pyrolysis products in a cold finger heat exchanger at ambient air temperature of approximately 11° C. The representative aqueous and oily portions of PS bio-oil were phase separated and used for MS analyses. The gasoline sample was collected from a commercial source (a gasoline station in Waco, Tex.), stored in a 10-mL eppendorf tube, and analyzed within about 20 minutes of sample collection.

Data Acquisition

Mass spectra were acquired using an IonSpec FT-ICR MS (formerly IonSpec Corp.—now a division of Agilent Technologies, Santa Clara, Calif.) equipped with a 9.4 tesla superconducting magnet (Cryomagnetics Inc., Oakridge, Tenn.) and a home-built RFI source. A detailed description of the FT-ICR instrument has been reported previously. See Szulejko et al., Simultaneous determination of analyte concentrations, gas-phase basicities, and proton transfer kinetics using gas chromatography/Fourier transform ion cyclotron resonance mass spectrometry, *Int. J. Mass Spectrom.,* 2006, 257 (1-3): 16-26, the disclosure of which is hereby incorporated in its entirety. Briefly, RFI-generated ions were trapped in an open-ended ICR cell for 1 s. The trapped ions were excited (for 4 ms) by using dipolar frequency sweep excitation and detected in the broadband mode. Fourier transformation of the acquired time-domain signals (128 k or 512 k data points) with one zero fill and Blackman window apodization followed by magnitude calculation and frequency-to-m/z conversion yielded the RFI/FT-ICR mass spectra shown in FIGS. 14-18. The observed ions in RFI/FT-ICR mass spectra of the analyzed samples as shown in FIGS. 14-18 corresponded to radical cations, protonated species, and fragment ions.

Vacuum Chamber

In this Example, ultrahigh vacuum (UHV) base pressures in the ICR cell region were below about $3.0\times10^{-9}$ torr. UHV pressures were measured (when the FT-ICR chamber was inserted into the bore of the magnet for MS operation) by direct reading of Granville-Phillips dual ion gauge controller and series 274 Bayard-Alpert type ionization gauge tube. Reported pressures have not been corrected for ionization sensitivity, geometry factor, or magnetic field effect. Mass spectra were calibrated internally, using m/z values for molecular and fragment ions from known standards such as ethanol, acetone, and toluene.

Sample Introduction

Liquid samples of about 100 μL of gasoline or bio-oil were transferred into separate teflon tubes and sealed at room temperature. Before MS analyses, samples in the sealed teflon tubes were degassed using conventional freeze-thaw degassing cycles. Room temperature VOCs (about 25° C.) present in the headspace volume of teflon tubes containing either gasoline or bio-oil samples were transferred into a heated expansion reservoir at about 200° C. Subsequently, these headspace VOCs were directly introduced into the FT-ICR vacuum chamber through a transfer line heated to about 200° C. and attached to a pulsed valve heated to about 120° C. Gasoline and bio-oil samples were introduced into the FT-ICR vacuum chamber for 50 ms and 200 ms, respectively. After each analysis, the expansion reservoir was evacuated using a vacuum pump. To assure that sample expansion reservoir was properly cleaned, prior to each analysis, "blank" mass spectra were acquired by pulsing contents of the evacuated reservoir into FT-ICR vacuum chamber for mass analysis. In all cases, "blank" mass spectra showed no detectable VOC signals. Samples were analyzed in triplicate runs to ensure reproducibility.

RFI Source and Ionization

In this Example, a home-built RF source as described in Zekavat and Solouki, Radio-Frequency Ionization of Organic Compounds for Mass Spectrometry Analysis, Angew. Chem. Int. Ed. Engl., 2013, 52:2426-2429 (hereby incorporated by reference in its entirety) was used for ion generation. An optimized RF signal at 6.5 MHz and about 200 $V_{bp}$ was applied to the quadrupole ion guide (QIG) rods of the FT-ICR instrument for 200 ms. A transistor-transistor logic (TTL) relay switch and IonSpec Omega software (version 8.0) was used to control the on/off states of the RF signals on QIG rods.

Mass Spectral data presented in this Example demonstrate the utility of RFI/MS for rapid analysis of VOCs in gasoline and bio-oil samples. Bio-oil and gasoline were selected as candidate VOC mixtures because the EI/MS analysis of VOCs in bio-oils and gasoline have been previously reported by J. E. Szulejko and T. Solouki, 74 Anal. Chem., 3434 (2002) and Feng Liang, et al., 15 Int. J. Ion Mobility Spectrom., 169 (2012).

Analysis by FT-ICR MS

Figure 14:
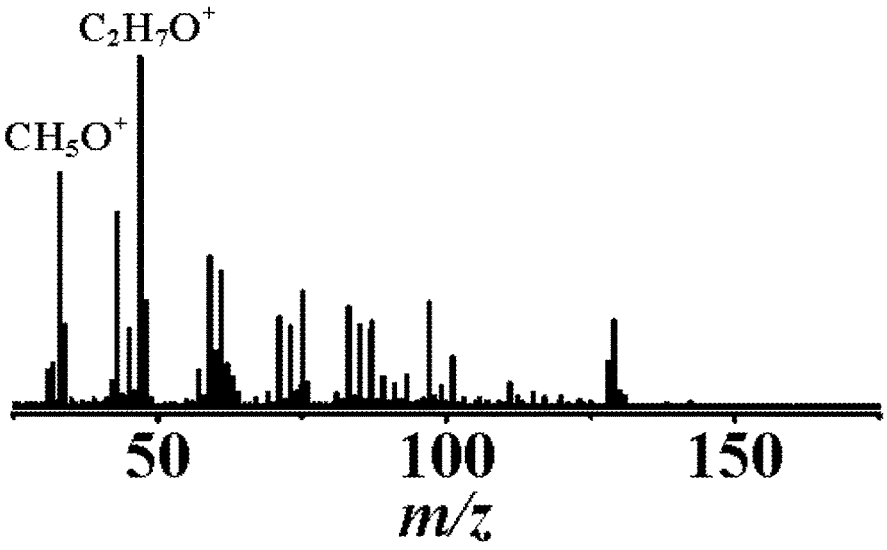
FIG. 14 shows an exemplary RFI/FT-ICR mass spectrum of VOCs from an aqueous phase of bio-oil derived from slow pyrolysis of pine shavings (PS) generated according to certain embodiments.
Figure 15:
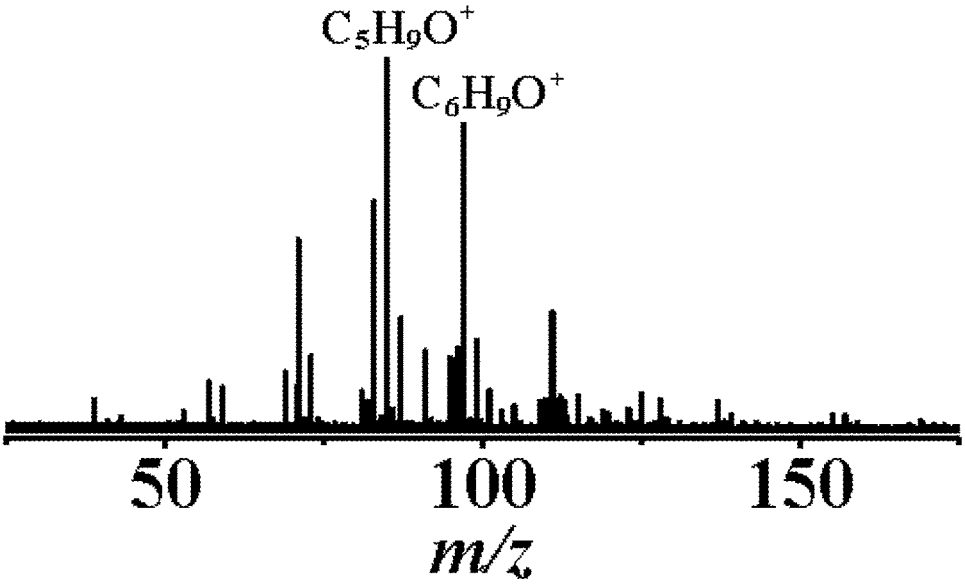
FIG. 15 shows an exemplary RFI/FT-ICR mass spectrum of volatile organic compounds (VOCs) from an oily phase of bio-oil derived from slow pyrolysis of pine shavings (PS).

FIGS. 14 and 15 show the RFI/FT-ICR mass spectra of VOCs present in the headspace of aqueous and oily phases of PS bio-oil, respectively. RFI of the VOCs in the aqueous and oily phases of PS bio-oil generated ions in the m/z ranges of 31 to 131 and 39 to 171, respectively. The total number of observed peaks (signal-to-noise ratio >3) in RFI/FT-ICR mass spectra of aqueous and oily phases of PS bio-oil were 66 and 64, respectively. Identities of the observed ions in FIGS. 14 and 15 can be assigned as saturated, unsaturated, and heteroatom (nitrogen (N), oxygen (O), and sulfur (S))-containing hydrocarbons.

Table 1 provides a list of the observed and theoretical (exact) m/z values, the mass measurement errors, assigned chemical compositions, and the double bond equivalents (DBEs) for the ionic species observed in the RFI/FT-ICR mass spectra of pine shavings (PS) bio-oil aqueous [PS (Aqueous)] and oily [PS (Oily)] phases. Additionally, Table 1 provides these values for a commercial gasoline sample. The (*) represents a Double Bond Equivalent (DBE). DBE=(Number of Carbon Atoms)−(Number of Hydrogen Atoms/2)+(Number of Nitrogen Atoms/2)+. The ✓ symbol indicates that the representative peak is present within the fragmentation pattern of the associated substance. The x symbol indicates that the representative peak is not present within the fragmentation pattern of the associated substance.

TABLE 1

| Obs. m/z | Exact m/z | Error (ppm) | Chemical Composition | DBE* | PS (Aqueous) | PS (Oily) | Gasoline |
|---|---|---|---|---|---|---|---|
| 29.03840 | 29.03858 | −6.19 | $C_2H_5^+$ | 0.5 | x | x | ✓ |
| 31.01790 | 31.01784 | 1.93 | $CH_3O^+$ | 0.5 | ✓ | x | ✓ |
| 32.02590 | 32.02567 | 7.18 | $CH_4O^{\bullet+}$ | 0.0 | ✓ | x | x |
| 33.03340 | 33.03349 | −2.72 | $CH_5O^+$ | −0.5 | ✓ | x | x |
| 39.02290 | 39.02293 | −0.77 | $C_3H_3^+$ | 2.5 | ✓ | ✓ | ✓ |
| 41.03860 | 41.03858 | 0.49 | $C_3H_5^+$ | 1.5 | ✓ | x | ✓ |
| 42.03390 | 42.03383 | 1.67 | $C_2H_4N^+$ | 1.5 | ✓ | x | x |
| 42.04620 | 42.04640 | −4.76 | $C_3H_6^{\bullet+}$ | 1.0 | x | x | ✓ |
| 43.01790 | 43.01784 | 1.39 | $C_2H_3O^+$ | 1.5 | ✓ | ✓ | ✓ |
| 43.05420 | 43.05423 | −0.69 | $C_3H_7^+$ | 0.5 | x | x | ✓ |
| 45.03355 | 45.03349 | 1.33 | $C_2H_5O^+$ | 0.5 | ✓ | x | ✓ |
| 47.04910 | 47.04914 | −0.85 | $C_2H_7O^+$ | −0.5 | ✓ | x | ✓ |
| 53.03850 | 53.03858 | −1.51 | $C_4H_5^+$ | 2.5 | ✓ | ✓ | ✓ |
| 55.01840 | 55.01784 | 10.18 | $C_3H_3O^+$ | 2.5 | x | ✓ | x |
| 55.05440 | 55.05423 | 3.09 | $C_4H_7^+$ | 1.5 | ✓ | x | ✓ |
| 56.04960 | 56.04948 | 2.14 | $C_3H_6N^+$ | 1.5 | ✓ | x | x |
| 56.06210 | 56.06205 | 0.89 | $C_4H_8^{\bullet+}$ | 1.0 | x | x | ✓ |
| 57.03355 | 57.03349 | 1.05 | $C_3H_5O^+$ | 1.5 | ✓ | ✓ | x |
| 57.06960 | 57.06988 | −4.91 | $C_4H_9^+$ | 0.5 | x | x | ✓ |
| 58.04100 | 58.04132 | −5.51 | $C_3H_6O^{\bullet+}$ | 1.0 | ✓ | x | x |
| 59.04940 | 59.04914 | 4.40 | $C_3H_7O^+$ | 0.5 | ✓ | ✓ | ✓ |
| 60.05550 | 60.05562 | −1.99 | $CH_6N_3^+$ | 0.5 | ✓ | x | x |
| 61.02840 | 61.02841 | −0.16 | $C_2H_5O_2^+$ | 0.5 | ✓ | x | x |
| 65.03835 | 65.03858 | −3.54 | $C_5H_5^+$ | 3.5 | x | ✓ | ✓ |
| 67.05459 | 67.05423 | 5.37 | $C_5H_7^+$ | 2.5 | ✓ | ✓ | ✓ |
| 69.03360 | 69.03349 | 1.59 | $C_4H_5O^+$ | 2.5 | ✓ | ✓ | x |
| 69.06990 | 69.06988 | 0.29 | $C_5H_9^+$ | 1.5 | ✓ | ✓ | ✓ |
| 70.06480 | 70.06513 | −4.71 | $C_4H_8N^+$ | 1.5 | ✓ | x | x |
| 70.07790 | 70.07770 | 2.85 | $C_5H_{10}^{\bullet+}$ | 1.0 | x | x | ✓ |
| 71.04925 | 71.04914 | 1.55 | $C_4H_7O^+$ | 1.5 | ✓ | ✓ | x |
| 71.08530 | 71.08553 | −3.24 | $C_5H_{11}^+$ | 0.5 | x | x | ✓ |
| 72.05640 | 72.05697 | −7.91 | $C_4H_8O^{\bullet+}$ | 1.0 | x | ✓ | x |
| 73.02820 | 73.02841 | −2.88 | $C_3H_5O_2^+$ | 1.5 | ✓ | x | x |
| 73.06490 | 73.06479 | 1.51 | $C_4H_9O^+$ | 0.5 | ✓ | ✓ | x |
| 75.04420 | 75.04406 | 1.87 | $C_3H_7O_2^+$ | 0.5 | ✓ | ✓ | x |
| 77.03970 | 77.03858 | 14.54 | $C_6H_5^+$ | 4.5 | x | x | ✓ |
| 78.04700 | 78.04640 | 7.69 | $C_6H_6^{\bullet+}$ | 4.0 | x | ✓ | ✓ |
| 79.05430 | 79.05423 | 0.89 | $C_6H_7^+$ | 3.5 | x | x | ✓ |
| 80.05050 | 80.04948 | 12.74 | $C_5H_6N^+$ | 3.5 | x | ✓ | x |
| 81.03295 | 81.03349 | −6.66 | $C_5H_5O^+$ | 3.5 | ✓ | ✓ | x |
| 81.07030 | 81.06988 | 5.18 | $C_6H_9^+$ | 2.5 | x | ✓ | ✓ |
| 82.04175 | 82.04132 | 5.24 | $C_5H_6O^{\bullet+}$ | 3.0 | ✓ | ✓ | x |
| 82.07690 | 82.07770 | −9.75 | $C_6H_{10}^{\bullet+}$ | 2.0 | x | x | ✓ |
| 83.04940 | 83.04914 | 3.13 | $C_5H_7O^+$ | 2.5 | ✓ | ✓ | x |
| 83.08600 | 83.08553 | 5.66 | $C_6H_{11}^+$ | 1.5 | x | ✓ | ✓ |
| 84.05585 | 84.05562 | 2.74 | $C_3H_6N_3^+$ | 2.5 | ✓ | ✓ | x |
| 84.09310 | 84.09335 | −2.97 | $C_6H_{12}^{\bullet+}$ | 1.0 | x | x | ✓ |
| 85.06500 | 85.06479 | 2.47 | $C_5H_9O^+$ | 1.5 | ✓ | ✓ | x |
| 85.10110 | 85.10118 | −0.94 | $C_6H_{13}^+$ | 0.5 | x | x | ✓ |
| 86.07245 | 86.07262 | −1.98 | $C_5H_{10}O^{\bullet+}$ | 1.0 | ✓ | ✓ | x |
| 87.04410 | 87.04406 | 0.46 | $C_4H_7O_2^+$ | 1.5 | ✓ | x | x |
| 87.08065 | 87.08044 | 2.41 | $C_5H_{11}O^+$ | 0.5 | ✓ | ✓ | x |
| 88.05180 | 88.05188 | −0.91 | $C_4H_8O_2^{\bullet+}$ | 1.0 | ✓ | x | x |
| 89.05995 | 89.05971 | 2.69 | $C_4H_9O_2^+$ | 0.5 | ✓ | ✓ | x |
| 90.06750 | 90.06753 | −0.33 | $C_4H_{10}O_2^{\bullet+}$ | 0.0 | ✓ | x | x |
| 91.01820 | 91.01784 | 3.96 | $C_6H_3O^+$ | 5.5 | x | ✓ | x |
| 91.05483 | 91.05423 | 6.59 | $C_7H_7^+$ | 4.5 | ✓ | ✓ | ✓ |
| 92.06190 | 92.06205 | −1.63 | $C_7H_8^{\bullet+}$ | 4.0 | ✓ | x | ✓ |
| 93.07020 | 93.06988 | 2.90 | $C_7H_9^+$ | 3.5 | ✓ | x | ✓ |
| 94.07770 | 94.07770 | 0.00 | $C_7H_{10}^{\bullet+}$ | 3.0 | x | ✓ | x |
| 95.01270 | 95.01276 | −0.63 | $C_5H_3O_2^+$ | 4.5 | ✓ | x | x |

TABLE 1-continued

| Obs. m/z | Exact m/z | Error (ppm) | Chemical Composition | DBE* | PS (Aqueous) | PS (Oily) | Gasoline |
|---|---|---|---|---|---|---|---|
| 95.05010 | 95.04914 | 10.10 | $C_6H_7O^+$ | 3.5 | x | ✓ | x |
| 95.08585 | 95.08553 | 3.37 | $C_7H_{11}^+$ | 2.5 | x | ✓ | ✓ |
| 96.02190 | 96.02058 | 13.75 | $C_5H_4O_2^{\bullet+}$ | 4.0 | ✓ | x | x |
| 96.05795 | 96.05697 | 10.20 | $C_6H_8O^{\bullet+}$ | 3.0 | ✓ | ✓ | x |
| 96.09340 | 96.09335 | 0.52 | $C_7H_{12}^{\bullet+}$ | 2.0 | x | x | ✓ |
| 97.02837 | 97.02841 | −0.41 | $C_5H_5O_2^+$ | 3.5 | ✓ | ✓ | x |
| 97.06515 | 97.06479 | 3.71 | $C_6H_9O^+$ | 2.5 | ✓ | ✓ | x |
| 97.10155 | 97.10118 | 3.81 | $C_7H_{13}^+$ | 1.5 | x | ✓ | ✓ |
| 98.03570 | 98.03623 | −5.41 | $C_5H_6O_2^{\bullet+}$ | 3.0 | ✓ | x | x |
| 98.07340 | 98.07262 | 7.95 | $C_6H_{10}O^{\bullet+}$ | 2.0 | x | ✓ | x |
| 98.10910 | 98.10900 | 1.02 | $C_7H_{14}^{\bullet+}$ | 1.0 | x | x | ✓ |
| 99.08095 | 99.08044 | 5.15 | $C_6H_{11}O^+$ | 1.5 | ✓ | ✓ | x |
| 99.11700 | 99.11683 | 1.72 | $C_7H_{15}^+$ | 0.5 | x | x | ✓ |
| 101.02400 | 101.02332 | 6.73 | $C_4H_5O_3^+$ | 2.5 | x | ✓ | x |
| 101.02940 | 101.02937 | 0.29 | $C_4H_7NS^{\bullet+}$ | 2.0 | ✓ | x | x |
| 101.06050 | 101.05971 | 7.82 | $C_5H_9O_2^+$ | 1.5 | ✓ | ✓ | x |
| 101.09600 | 101.09609 | −0.89 | $C_6H_{13}O^+$ | 0.5 | ✓ | ✓ | x |
| 102.04530 | 102.04640 | −10.78 | $C_8H_6^{\bullet+}$ | 6.0 | x | ✓ | x |
| 103.05400 | 103.05420 | −2.23 | $C_8H_7^+$ | 5.5 | x | x | ✓ |
| 103.07610 | 103.07536 | 7.18 | $C_5H_{11}O_2^+$ | 0.5 | ✓ | ✓ | x |
| 105.06450 | 105.06585 | −12.85 | $C_3H_9N_2O_2^+$ | 0.5 | ✓ | x | x |
| 105.06970 | 105.06988 | −1.71 | $C_8H_9^+$ | 4.5 | x | ✓ | ✓ |
| 106.07830 | 106.07770 | 5.18 | $C_8H_{10}^{\bullet+}$ | 4.0 | x | ✓ | ✓ |
| 107.08580 | 107.08553 | 2.05 | $C_8H_{11}^+$ | 3.5 | ✓ | x | ✓ |
| 109.06550 | 109.06479 | 6.51 | $C_7H_9O^+$ | 3.5 | x | ✓ | x |
| 109.10070 | 109.10118 | −4.86 | $C_8H_{13}^+$ | 2.5 | x | ✓ | ✓ |
| 110.03650 | 110.03623 | 2.45 | $C_6H_6O_2^{\bullet+}$ | 4.0 | ✓ | x | x |
| 110.07320 | 110.07262 | 5.27 | $C_7H_{10}O^{\bullet+}$ | 3.0 | x | ✓ | x |
| 110.10860 | 110.10900 | −3.63 | $C_8H_{14}^{\bullet+}$ | 2.0 | x | x | ✓ |
| 111.03190 | 111.03148 | 3.78 | $C_5H_5NO_2^{\bullet+}$ | 4.0 | x | ✓ | x |
| 111.04330 | 111.04406 | −6.84 | $C_6H_7O_2^+$ | 3.5 | ✓ | x | x |
| 111.08070 | 111.08044 | 2.34 | $C_7H_{11}O^+$ | 2.5 | ✓ | ✓ | x |
| 111.11680 | 111.11683 | −0.27 | $C_8H_{15}^+$ | 1.5 | x | x | ✓ |
| 112.08590 | 112.08692 | −9.10 | $C_5H_{10}N_3^+$ | 2.5 | x | ✓ | x |
| 112.12540 | 112.12465 | 6.69 | $C_8H_{16}^{\bullet+}$ | 1.0 | x | x | ✓ |
| 113.09470 | 113.09475 | −0.44 | $C_5H_{11}N_3^{\bullet+}$ | 2.0 | ✓ | x | x |
| 113.09630 | 113.09609 | 1.86 | $C_7H_{13}O^+$ | 1.5 | x | ✓ | x |
| 113.13220 | 113.13248 | −2.47 | $C_8H_{17}^+$ | 0.5 | x | x | ✓ |
| 115.07560 | 115.07536 | 2.09 | $C_6H_{11}O_2^+$ | 1.5 | ✓ | ✓ | x |
| 117.05430 | 117.05462 | −2.73 | $C_5H_9O_3^+$ | 1.5 | ✓ | x | x |
| 117.06960 | 117.06988 | −2.39 | $C_9H_9^+$ | 5.5 | x | x | ✓ |
| 119.08570 | 119.08553 | 1.43 | $C_9H_{11}^+$ | 4.5 | x | ✓ | ✓ |
| 120.09290 | 120.09335 | −3.75 | $C_9H_{12}^{\bullet+}$ | 4.0 | x | x | ✓ |
| 121.1020 | 121.10118 | 6.36 | $C_9H_{13}^+$ | 3.5 | ✓ | x | ✓ |
| 123.07960 | 123.08044 | −6.82 | $C_8H_{11}O^+$ | 3.5 | ✓ | x | x |
| 124.12410 | 124.12465 | −4.43 | $C_9H_{16}^{\bullet+}$ | 2.0 | x | x | ✓ |
| 125.05890 | 125.05836 | 4.32 | $C_5H_7N_3O^{\bullet+}$ | 4.0 | ✓ | x | x |
| 125.09660 | 125.09609 | 4.08 | $C_8H_{13}O^+$ | 2.5 | ✓ | ✓ | x |
| 125.13190 | 125.13248 | −4.64 | $C_9H_{17}^+$ | 1.5 | x | x | ✓ |
| 128.06270 | 128.06205 | 5.08 | $C_{10}H_8^{\bullet+}$ | 7.0 | ✓ | ✓ | x |
| 129.06950 | 129.06988 | −2.94 | $C_{10}H_9^+$ | 6.5 | ✓ | x | x |
| 129.09030 | 129.08966 | 4.96 | $C_5H_{11}N_3O^{\bullet+}$ | 2.0 | x | ✓ | x |
| 130.07550 | 130.07368 | 13.99 | $C_5H_{10}N_2O^{\bullet+}$ | 2.0 | ✓ | x | x |
| 131.07310 | 131.07295 | 1.14 | $C_9H_9N^{\bullet+}$ | 6.0 | ✓ | x | x |
| 131.08400 | 131.08553 | −11.67 | $C_{10}H_{11}^+$ | 5.5 | x | x | ✓ |
| 132.04270 | 132.04171 | 7.49 | $C_5H_8O_4^{\bullet+}$ | 2.0 | x | ✓ | x |
| 133.04990 | 133.04954 | 2.71 | $C_5H_9O_4^+$ | 1.5 | x | ✓ | x |
| 133.10140 | 133.10118 | 1.65 | $C_{10}H_{13}^+$ | 4.5 | x | x | ✓ |
| 134.10980 | 134.10900 | 5.97 | $C_{10}H_{14}^{\bullet+}$ | 4.0 | x | x | ✓ |
| 135.11820 | 135.11683 | 10.14 | $C_{10}H_{15}^+$ | 3.5 | x | x | ✓ |
| 137.13390 | 137.13248 | 10.35 | $C_{10}H_{17}^+$ | 2.5 | x | ✓ | x |
| 138.10450 | 138.10392 | 4.20 | $C_9H_{14}O^{\bullet+}$ | 3.0 | x | ✓ | x |
| 139.11370 | 139.11174 | 14.09 | $C_9H_{15}O^+$ | 2.5 | x | ✓ | x |
| 143.05320 | 143.05117 | 14.19 | $C_5H_9N_3S^{\bullet+}$ | 3.0 | x | ✓ | x |
| 155.10750 | 155.10666 | 5.42 | $C_9H_{15}O_2^+$ | 2.5 | x | ✓ | x |
| 171.14040 | 171.13796 | 14.26 | $C_{10}H_{19}O_2^+$ | 1.5 | x | ✓ | x |

As shown in Table 2 analyzed VOCs in the aqueous and oily phases of PS bio-oil were mainly O-containing compounds. Total percentages of oxygenated VOCs in the aqueous and oily phases of PS bio-oil were 68% and 64%, respectively. The oxygenated VOC compositions of PS bio-oil deduced from RFI/FT-ICR MS analyses in this Example are consistent with previously reported gas chromatography (GC)/EI/MS data. Previous GC/EI/MS data suggested the presence of various O-containing compounds such as acids, alcohols, esters, furans, and ketones as major classes of compounds in bio-oils.

To assign chemical structures to RFI-generated ions, gas-phase ion fragmentation techniques were employed. For example, m/z isolation followed by sustained off-resonance irradiation-collision induced dissociation (SORI-CID) (in the ICR cell) was used to identify chemical structure of an ion at m/z 85.0648 in the RFI mass spectrum of the oily phase of PS bio-oil of FIG. 15. Comparison of the SORI-CID mass spectrum of m/z 85.0648 with SORI-CID mass spectra of a series of standard candidates (data not shown) suggested the presence of cyclopentanone in aqueous and oily phases of PS bio-oil. Cyclopentanone has been previously observed as one of the volatile pyrolysis products of bio-oils. See Liu, 26 Energy & Fuels at 4532.

Comparison between RFI/FT-ICR mass spectra of the aqueous phase of PS bio-oil, FIG. 14, and oily phase of PS bio-oil, FIG. 15 revealed clear qualitative and quantitative differences. For instance, small mass ions (m/z<70) were present at higher relative abundances in the aqueous phase, as shown in FIG. 14, than in the oily phase, as shown in FIG. 15, of PS bio-oil. Conversely, the larger mass ions (70<m/z<110) were present at higher relative abundances in the oily phase, as shown in FIG. 15 as compared to the aqueous phase, as shown in FIG. 14 of PS bio-oil. Moreover, the aqueous phase contained low mass species such as $C_2H_7O^+$ (m/z 47.0491), which were not present in the oily phase. On the other hand, the oily phase contained higher carbon number sample-specific species, such as $C_6H_7O^+$ (m/z 95.0491), which were not detected in the aqueous phase. Based on the RFI/FT-ICR MS data presented in FIGS. 14 and 15 and summarized data in Tables 1 and 2, the aqueous and oily phases of PS bio-oil can be distinguished.

RFI/FT-ICR MS was also used to compare the VOC compositions of a commercially available gasoline sample and PS bio-oil samples (aqueous and oily phases). Such comparisons can be used as an initial screening step for selection of bio-oils as energy sources for gasoline production or gasoline additives. For example, previous studies have shown that the use of optimized gasoline and bio-fuel blends can improve vehicle engine performance and decrease emissions of carbon monoxide (CO), nitrogen oxides (NOx), and hydrocarbons. See N. Misron, S. Rizuan, A. Vaithilingam, N. F. Mailah, H. Tsuyoshi, Y. Hiroaki and S. Yoshihito, 4 Energies, 1937-1949 (2011) and M. Canakci, A. N. Ozsezen, E. Alptekin and M. Eyidogan, 52 Renew. Energy, 111 (2013).

Figure 16:
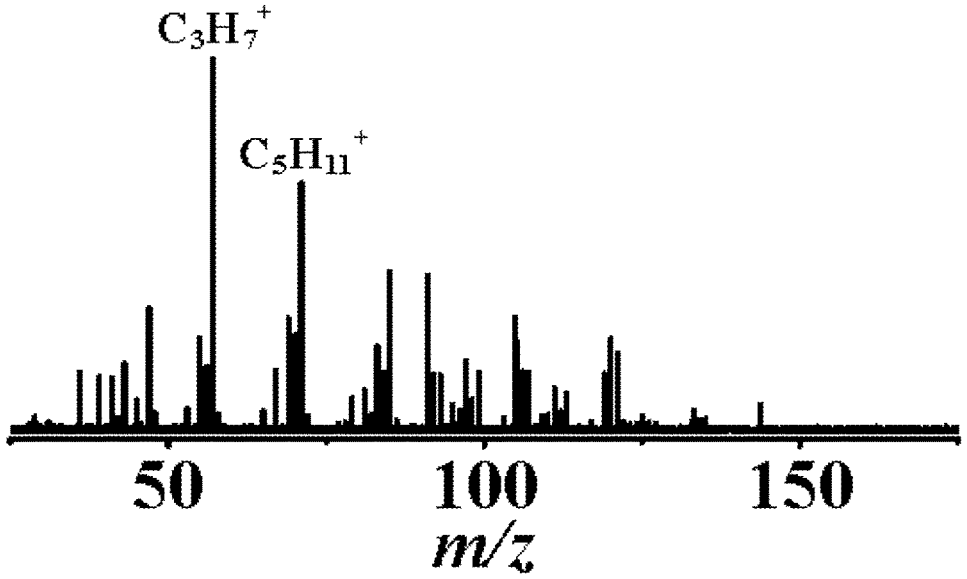
FIG. 16 shows an exemplary RFI/FT-ICR mass spectrum of a commercially available gasoline sample.

FIG. 16 shows the RFI/FT-ICR mass spectrum of the headspace VOCs in a commercial gasoline sample. As shown in Table 1, the RFI/FT-ICR mass spectrum of gasoline showed a total of 54 identifiable peaks (S/N>3), spanning the m/z range of 29 to 135. Unlike the PS bio-oil samples, as shown in Table 2, the gasoline sample contained a large percentage (91%) of non-oxygenated VOCs. Among the observed oxygenated VOCs in the gasoline sample, $C_2H_7O$+ (m/z 47.0491) had the highest relative abundance.

TABLE 2

Percentages of oxygenated and non-oxygenated compounds in PS bio-oil aqueous and oily phases and a commercial gasoline sample

| $O_x$-Containing Classes | PS (Aqueous) | PS (Oily) | Gasoline |
|---|---|---|---|
| $O_0$ | 32% | 36% | 91% |
| $O_1$ | 42% | 45% | 9% |
| $O_2$ | 24% | 14% | 0% |
| $O_3$ | 2% | 2% | 0% |
| $O_4$ | 0% | 3% | 0% |

A majority of VOCs observed in the RFI/FT-ICR mass spectrum of gasoline were similar to VOCs previously observed and reported using GC/EI/FT-ICR MS. See J. E. Szulejko and T. Solouki, 74 Anal. Chem., 3434 (2002). Presumably, the observed minor differences are due to the different sources of gasoline samples and the different experimental conditions presently used in RFI/FT-ICR MS and previously used in GC/EI/FT-ICR MS.

An observed difference that could potentially be sample-related is the detection of different O-containing gasoline additives. As evidenced by the presence of the MTBE EI fragment ion at m/z 73.0648 ($C_4H_9O^+$), methyl tert-butyl ether (MTBE) was detected in previous GC/EI/FT-ICRMS analysis of a commercial gasoline sample. See Id. In contrast, the MTBE-related ionic species (e.g., MTBE radical cation and/or pseudo molecular ion, or fragment ion at m/z 73.0648) was not observed in the gasoline sample presently analyzed using RFI/FT-ICR. Instead, FIG. 16 shows the presence of $C_2H_7O^+$ at m/z 47.0491 (not labeled in FIG. 16). The $C_2H_7O^+$ ion was not observed in the previous GC/EI/FT-ICR MS study. The $C_2H_7O^+$ could potentially be assigned as protonated ethanol (chemical ionization (CI) and self-CI product of a gasoline additive). These observations are consistent with the current use of ethanol as a gasoline additive in Texas, the commercial sample of FIG. 16 was drawn in Waco, Tex. and the former use of MTBE as an additive in the Maine gasoline samples use in the previous GC/EI/FT-ICR MS study. See Id.

Figure 17:
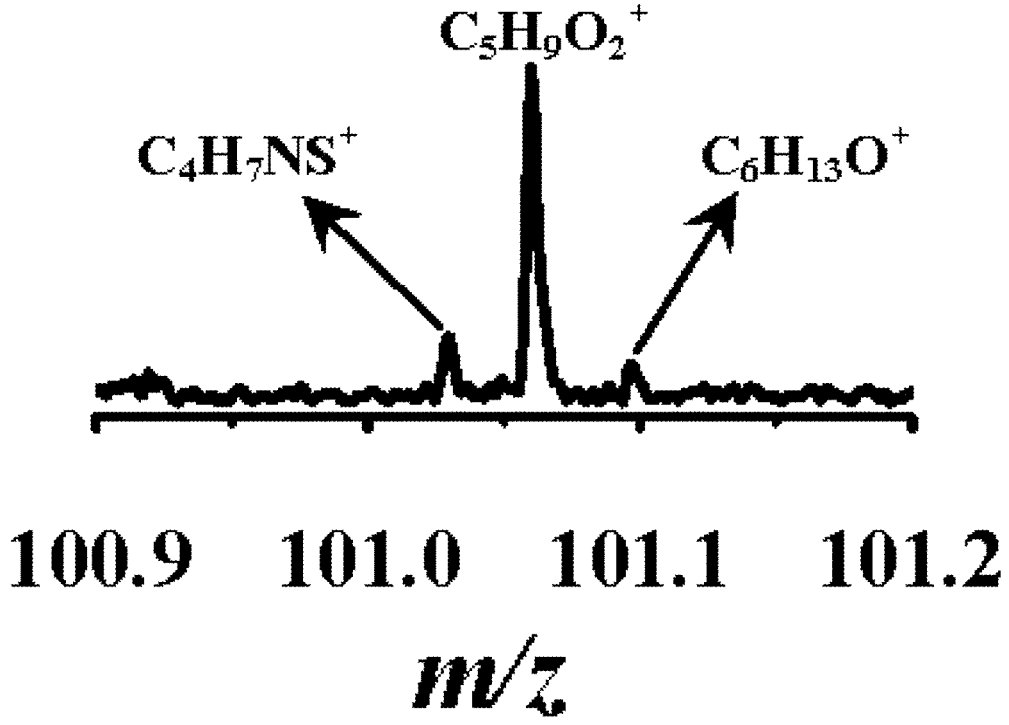
FIG. 17 depicts an expanded view of an exemplary m/z range 100.9 to 101.2 for RFI/FT-ICR mass spectrum of an aqueous phase of a bio-oil derived from slow pyrolysis of pine shavings (PS).
Figure 18:
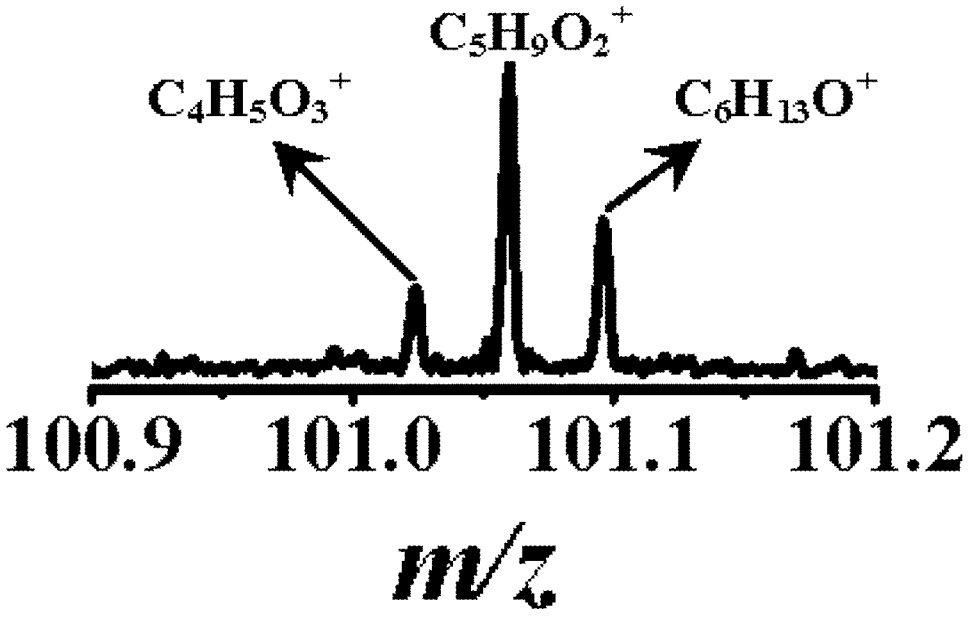
FIG. 18 depicts an expanded view of an exemplary m/z range 100.9 to 101.2 for RFI/FT-ICR mass spectrum of an oily phase of a bio-oil derived from slow pyrolysis of pine shavings (PS).

The characteristic m/z spacing, (e.g., 0.036 Th for the substitution of $CH_4$ vs. O) for various species present in the two phases of PS bio-oil can be observed in RFI/FT-ICR mass spectra. For instance, FIGS. 17 and 18 show expanded views of the m/z range 100.9 to 101.2 for RFI/FT-ICR mass spectra of aqueous and oily phases of PS bio-oil at mass resolving power (m/Δm50%) of about 20,000, respectively. For each mass spectrum, FT-ICR MS time-domain transients of 512 k data points were summed prior to Fourier transformation. For each mass spectrum, FT-ICR MS time-domain transients of 512 k data points were summed prior to Fourier transformation. As shown, the observed nominally isobaric species could be assigned as $C_4H_7NS$+ (at m/z 101.0294 with 0.3 ppm error, panel a), $C_4H_5O_3$+ (at m/z 101.0240 with 7.0 ppm error, panel b), $C_5H_9O_2$+ (at m/z 101.0599 with 2.0 ppm error), and $C_6H_{13}0$+ (at m/z 101.0964 with 3.0 ppm error). It is noteworthy that only one S-containing VOC was observed in each PS bio-oil phase. This consistent with previous reports on the presence of negligible amount (<0.09% wt) of S-containing compounds in bio-oil samples. See Id.

This example shows the successful implementation of RFI/FTICR MS for detection of volatile and semi-volatile organic compounds, gasoline, and bio-oil samples. The mass spectral patterns in RFI were similar to those generated by EI at 70 eV and contained both pseudo molecular and fragment ions. However, RFI offers several advantages that can minimize the challenges associated with the use of EI for VOC analysis with MS. For instance, the issues related to the use of EI with FT-ICR MS include: high background pressure in ICR cell due to outgassing of the heated electrical components surrounding the EI filament, the presence of chemical noise due to ionization of the outgassed materials, and thetime-penalties associated with frequent replacement of the fragile EI filaments, which are normally placed within a high magnetic field region for FT-ICR instruments. Because RFI can be operated in pulsed mode, surface heating and resultant outgassing are minimal. Additionally, RFI is more robust and not disposed to filament burning and other damages that are commonly observed in EI experiments. Moreover, MS results suggest that different classes of VOCs (e.g., saturated, unsaturated, and heteroatom-containing hydrocarbons) can be ionized by RFI and and differentiated by RFI/FT-ICR MS analyses of their headspace VOCs. This level of discrimination, within RFI, was not previously known.

EQUIVALENTS AND SCOPE

Those skilled in the art will recognize, or be able to ascertain using no more than routine experimentation, many equivalents to the specific embodiments of the invention described herein. The scope of the present invention is not intended to be limited to the above description, but rather is as set forth in the following claims:

We claim:

1. A method of performing ionization, comprising:

providing a pair of trapping plates located within a chamber, wherein the pair of trapping plates define a first end and a second end of a cell, the first end trapping plate comprising at least one opening allowing passage of ions therethrough, and introducing an analyte into the chamber, wherein a partial pressure of the analyte after its introduction into the chamber is between about $1\times10^{-3}$ torr and about $1\times10^{-12}$ torr; and applying a radio frequency (RF) signal to an ion guide assembly comprising at least one ion guide rod, wherein the ions are formed in a gap between an exposed end of the at least one ion guide rod and the first end trapping plate.

2. The method of claim 1, further comprising detecting the ions with a mass spectrometer (MS).

3. The method of claim 2, wherein the MS is selected from the group consisting of: a quadrupole MS, a sector (electric and magnetic) instrument, a Fourier Transform Ion Cyclotron Resonance (FT-ICR) MS, a Time of Flight (TOF) MS, and an Orbitrap MS.

4. The method of claim 1, wherein a frequency of the RF signal is between about 1.0 MHz to about 100 MHz.

5. The method of claim 1, wherein the gap between the exposed end of the at least one ion guide rod and the first end trapping plate is between about 0.1 nm and about 4 mm.

6. The method of claim 1, wherein the analyte comprises one or more chemical compounds.

7. The method of claim 1, wherein the analyte is or comprises a gas.

8. The method of claim 1, wherein the analyte is or comprises a liquid.

9. The method of claim 1, wherein the analyte is or comprises a solid.

10. The method of claim 1, wherein the step of applying comprises applying radio frequency energy to the analyte for between about 0.001 second and about 3.0 seconds, inclusive.

11. The method of claim 1, wherein the at least one opening is located off-axis of a central axis that is longitudinally parallel with the at least one ion guide rod of the ion guide assembly.

12. The method of claim 2, further comprising:

positioning a wire ion guide between the first and second end trapping plates inside the cell, wherein the wire ion guide is electrically isolated from the cell; and applying a voltage to the wire ion guide during ion excitation and detection.

13. The method of claim 12, wherein the wire is copper, silver, and/or gold.

14. The method of claim 12, wherein the voltage is pulsed.

15. An ionization system, comprising:

a source of radio frequency (RF) energy for providing power for production of ions;

a chamber;

a pair of trapping plates located within the chamber, wherein the pair of trapping plates define a first end and a second end of a cell, the first end trapping plate comprising at least one opening allowing passage of ions therethrough;

an ion guide assembly comprising at least one ion guide rod, wherein the ions are formed in a gap between an exposed end of the at least one ion guide rod and the first end trapping plate; and a wire ion guide positioned between a center of the end trapping plates in the cell, wherein the wire ion guide is electrically isolated from the cell.

16. The system of claim 15, wherein the gap between the exposed end of the at least one ion guide rod and the first end trapping plate is between about 0.1 nm and about 4 mm.

17. The system of claim 15, further comprising a mass spectrometer (MS).

18. The system of claim 17, wherein the mass spectrometer is selected from the group consisting of a quadrupole MS, a sector (electric and magnetic) instrument, a Fourier Transform Ion Cyclotron Resonance (FT-ICR) MS, a Time of Flight (TOF) MS, and an Orbitrap MS.

19. The system of claim 15, wherein the source of RF energy is located in the chamber.

20. The system of claim 15, wherein the at least one opening is located off-axis of a central axis that is longitudinally parallel with the at least one ion guide rod of the ion guide assembly.

21. The system of claim 15, wherein the wire is copper.

22. The system of claim 15, further comprising an aperture for introducing an analyte.

23. The system of claim 15, wherein the at least one opening has a diameter between about 1 nm and about 1.0 cm.

* * * * *